US006831670B2

(12) United States Patent
Fujiwara

(10) Patent No.: US 6,831,670 B2
(45) Date of Patent: Dec. 14, 2004

(54) PRINTER

(75) Inventor: Hitoshi Fujiwara, Nagano (JP)

(73) Assignees: F&F Limited (JP); SII P&S Inc. (JP)

( * ) Notice: Subject to any disclaimer, the term of this patent is extended or adjusted under 35 U.S.C. 154(b) by 0 days.

(21) Appl. No.: 10/182,188

(22) PCT Filed: Nov. 27, 2001

(86) PCT No.: PCT/JP01/10305

§ 371 (c)(1),
(2), (4) Date: Nov. 15, 2002

(87) PCT Pub. No.: WO02/42084

PCT Pub. Date: May 30, 2002

(65) Prior Publication Data

US 2003/0146964 A1 Aug. 7, 2003

(30) Foreign Application Priority Data

Nov. 27, 2000 (JP) ..... 2000-359785

(51) Int. Cl.[7] ..... B41J 11/66
(52) U.S. Cl. ..... 347/222; 346/24
(58) Field of Search ..... 347/24, 222, 218, 347/262, 264, 220, 139, 153, 104, 101; 400/621; 346/24

(56) References Cited

FOREIGN PATENT DOCUMENTS

| | | | |
|---|---|---|---|
| JP | 05-244337 | A | 9/1993 |
| JP | 06-198989 | A | 7/1994 |
| JP | 2000-061881 | A | 2/2000 |

OTHER PUBLICATIONS

PCT/JP01/10305, International Search Report.

*Primary Examiner*—Huan Tran
(74) *Attorney, Agent, or Firm*—Blank Rome LLP

(57) ABSTRACT

A printer includes a line thermal head, a platen roller for holding a paper between the platen roller and the line thermal head and feeding the paper, a cutter, including a movable blade and a fixed blade, for cutting printed paper, and a cutter driving mechanism for driving the movable blade. At least one of the line thermal head and the platen roller can be moved from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves. In this way, a compact printer that uses roll paper, has a cutter function, and makes it easy to remove paper jams can be provided.

18 Claims, 14 Drawing Sheets

(a)

Home Position H (b)

Cutting Position C (a)

First Position P (b)

Second Position R

Home Position H

Cutting Position C (a)

Home Position H (b)

Cutting Position C

PRINTER

RELATED APPLICATIONS.

This application is the U.S. National Phase Application of PCT/JP01/10305, Published as WO 02/42084-A1, the full disclosures of which are incorporated by reference herein.

TECHNICAL FIELD

The present invention relates to a printer equipped with a function for cutting paper.

RELATED ART

Conventionally printers have been widely used in the home as output devices for fax machines and in establishments as output devices for Point of Sale (POS) units. Many of such printers print onto paper supplied from a roll. In recent years, however, compact printers such as ink jet printers have come into increasing use in homes and offices. These printers print onto standardized sizes, such as A4, of cut sheets or cut paper. In keeping with this trend, many recent fax or facsimile machines also use cut sheets, with such machines becoming increasingly common in the home.

However, compared to printers that use cut sheets, roll paper-type printers have an advantage in that it is easier to make the overall size of the printer compact. In the case of a cut-sheet printer, a printer that can print on cut sheets of a given size such as A4 (21 cm by 29 cm), the printer needs to be at least big enough to store A4 sheets (21 cm by 29 cm) in a laid-out manner. On the other hand, a roll paper-type printer needs to be as wide as the A4 size (21 cm for example), but only sufficiently deep to accommodate the diameter of the roll, which can be only a few centimeters across, for example.

In recent years, in particular there has been demand for printers that can be carried with a mobile computer (mobile terminal), such as a mobile phone or a PDA (Personal Data Assistant), and can be connected to such a mobile computer so that printing becomes easily performed in any location. Small, slimline printers that can print on A6 size (10.5 cm by 4.8 cm), for example, or smaller paper are desired. Since the overall sizes of roll-paper type printers are more compact than those of cut sheet-type printers, roll-paper type printers are well-suited to use as portable, compact, slimline printers.

Compared to a serial-type printer, in which printing is performed while a print head is traveled in the scanning direction, it is easier to produce a thermal-type printer, which has a line thermal head and a platen roller for feeding paper while pressing the paper onto the line thermal head, as a compact printer since there is no need for space in which to run the print head in the scanning direction or for a mechanism for moving the print head. If thermal paper is used, there is no need for consumables such as ink, toner or an ink ribbon, which makes maintenance easier and makes it unnecessary to provide space for storing the consumables. This means that thermal paper is especially suited to compact, portable printers. For these reasons, paper-roll-type line printers can be produced in slimline, compact designs, making them suitable as printers that are carried along with PDAs or mobile phones and are used together with such devices, or as printers for personal use that can be used in place of a conventional memo pad.

Printers also need to be user-friendly devices. When a paper-roll type printer is used, the printed paper that is discharged from the printer needs to be cut into sheets of a desired size, so that some paper-roll type printers can be cumbersome to use. While it is possible to provide a blade at the discharge slot to enable the user to manually cut the printed paper that is discharged, when a plurality of pages are printed out consecutively, the print operation has to stop every time a page has been printed out so that the page can be manually cut off the roll, making the printing operation cumbersome. On the other hand, a plurality of pages may be consecutively printed, though in such case the user then has to go to the trouble of cutting the paper roll into separate pages.

Some conventional A4 fax machines are equipped with a cutter for automatically cutting the printed paper roll into A4-sized sheets. There is no need for the user to cut each page by hand, and a page by page printout, not a continuous printed roll, is obtained when a multiple page document is received. However, there are a number of problems when incorporating this kind of cutter mechanism into an A6 or smaller portable, slimline printer as mentioned above. A first problem is how to incorporate a cutter in a compact manner without increasing the bulkiness of the printer. Unlike a fax machine or a conventional desktop printer where there are no particular problems if the thickness and width or length are several dozen centimeters, a postcard or business card size printer has to be compact and slimline (for example, a thickness of between a few centimeters and 1 cm, or less) with a width and length of a few centimeters, and it is preferable for the cutter mechanism to be added without changing the size of the printer.

It is also extremely difficult to completely prevent paper jams from occurring for a printer, so that a printer needs to have a construction that makes it possible to remove a paper jam. When a cutter mechanism is provided, the cutter makes it difficult to access the paper feeding path and to remove the paper jamming the printer from the paper path. In particular, in the type of compact, portable printer described above, the paper path (paper feeding route) is designed to be virtually the most compact route possible, so that it is very difficult to come up with a design that makes it easy for users to remove paper jams. When a cutter mechanism is additionally provided, it becomes even more difficult to remove a paper jam. In order to stop excessively large margins being left on the printed roll, the cutter should preferably be disposed so as to cut the paper as close as possible to the line thermal head. Also, to make the overall design of a printer compact, it is preferable to position the cutter mechanism as close as possible to the thermal head and the platen roller. This means that the cutter prevents access to the point at which the paper is held between the thermal head and the platen roller, so that it is difficult to provide a compact, portable printer that is easy to use anytime and anywhere.

It is a first object of the present invention to provide a compact printer which uses a paper roll and is internally provided with a cutter mechanism, and with which paper jams can be easily removed. It is a second object of the present invention to provide a compact printer that can be carried together with a mobile terminal, is easy to maintain, and can print reliably wherever the printer is used.

DISCLOSURE OF THE INVENTION

A printer according to the present invention uses a cutter mechanism that includes a movable blade and a fixed blade. The printer also includes a line thermal head and a platen roller and one of the line thermal head and the platen roller can be moved to a position (the second position) where paper jams can be removed, and one of the fixed blade and the movable blade directly or indirectly attached to one of the line thermal head and the platen roller so that when the line thermal head or platen roller is moved to the second position, one of the movable blade and the fixed blade is also moved together with one of the line thermal head and the platen roller. This is to say, the printer of the present invention includes: a line thermal head; a platen roller for holding a paper between the platen roller and the line thermal head and feeding the paper; a cutter, including a movable blade and a fixed blade, for cutting printed paper; and a cutter driving mechanism for driving the movable blade, wherein at least one of the line thermal head and the platen roller can be moved from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller.

First, with the printer according to the present invention, at least one of the line thermal head and platen roller that hold the paper can be moved or removed, so that when a paper jam has occurred, at least one of these components can be moved to the second position that is above or below, in front or behind, or left or right relative to the first position, thereby releasing the paper from between the line thermal head and the platen roller and making it easy for the paper jam to be removed or solved. In the present invention, the second position does not refer to only a fixed position, and also includes positions away from the printer main body to which the line thermal head or the platen roller is moved to relative to the first position in an up-down, front-back, or left-right direction. The cutter is realized by a combination of a movable blade and a fixed blade, with either of these blades being attached to the line thermal head and the other being attached to the platen roller, so that when the line thermal head or the platen roller is moved, the movable blade or the fixed blade is also moved. This means that there is no need to remove the cutter before moving the line thermal head or the platen roller and that the movable blade or the fixed blade is moved by moving the line thermal head or the platen roller, so that the cutter does not block access to a path where paper jams occur.

By moving the line thermal head or the platen roller, the paper that is held between the line thermal head and the platen roller is released and paper that is held due to the engagement of the movable blade and the fixed blade or by improper engagement of the movable blade and fixed blade is also released due to the movement of the movable blade or the fixed blade. Accordingly, with the printer according to the present invention, paper even if the paper is held by the cutter, when a paper jam has occurred, can be released merely by an operation that moves or removes the line thermal head or the platen roller. Either the movable blade or the fixed blade moves, so that the cutter does not obstruct the movement of the line thermal head or the platen roller and the cutter does not obstruct the removal of the paper. This means that even though the printer is equipped with a cutter, maintenance is extremely easy, and paper jams can be easily removed.

By attaching the movable blade and the fixed blade to the line thermal head and platen roller respectively, the cutter can be disposed as close as possible to the line thermal head. Also, by attaching the movable blade and the fixed blade to the line thermal head and platen roller respectively, the movable blade and the line thermal head, for example, can be provided as a single unit and the fixed blade and the platen roller can be provided as another single unit. The printer can be made compact, and the printer becomes easier to assemble, making the printer suited to use as a slimline, compact printer. By combining the above components into single units, it becomes no longer necessary to provide components and it's space for supporting the movable blade or fixed blade from the housing or chassis of the printer, which reduces the burden of producing the housing or chassis and is very effective at reducing the required amount of space. As one example, by assembling the unit in which the movable blade is attached to the line thermal head and the unit in which the fixed blade is attached to the platen roller to the housing or chassis, the number of assembly processes is reduced. There is also a reduction in the number of attachment processes for tight spaces and alignment adjustments, which simplifies the assembly of the printer.

In this way, the printer of the present invention makes it easy to remove paper jams and has a construction which from the viewpoint of the ease of assembly is suited to compact printers. Since there are reductions in the number of parts and in the number of assembly processes, a compact printer can be provided at low cost. According to the present invention, a printer that is easy to use anywhere and at any time can be provided at low cost. This printer includes printers that can store roll paper and printers where a roll paper cassette can be attached and detached.

In view of easy disassembling for removing paper jams, when the line thermal head and the platen roller are at the first position where printing can be performed, it is preferable for the movable blade to be disposed at a direction of the second position with respect to the fixed blade, which is to say, in the direction the line thermal head or the platen roller will move, so as to the movable blade moves together with the one of the line thermal head and the platen roller. When a paper jam has occurred, it is believed that there will be cases where the movable blade cannot be backed to the home position. In such cases, withdrawing the movable blade makes the paper feeding route normal and the paper jam can be removed easily. In order to withdraw a movable blade that has not returned to the home position, it is preferable for the movable blade to be on a side to which the movable blade is withdrawn to the fixed blade.

In a compact printer, there are cases where the platen roller has a small diameter and it is easy for find space for moving the movable blade close to the line thermal head. In such cases, it is preferable for the movable blade to be attached to the line thermal head and for the fixed blade to be attached to the platen roller. When the fixed blade is attached to the platen roller, the shaft of the platen roller can be used as the fitting points for installing the fixed blade. When the movable blade is attached to the line thermal head, a support plate to which the line thermal head is attached can be used as the fitting parts, with the movable blade being disposed so as to slide along the support plate.

On the other hand, it is also effective to construct a printer so that the movable blade moves together with the platen roller. If the platen roller can be removed, it becomes possible to access the entire paper feeding route when setting the roll paper or removing a paper jam. This makes it extremely easy to set the roll paper and remove a paper jam.

Printers often have a housing or chassis with a flat surface on the side from which printed paper is discharged, and it is preferable for the movable blade to be disposed so as to work along this flat surface. By disposing the movable blade in this way, the space that is required in the thickness direction of the movable blade to work can be minimized. This means that sufficient space for the movable blade to slide can be provided with almost no increase in the thickness of the printer. By arranging gears and/or arms included in the cutter driving mechanism parallel to the movable blade along the flat surface where the paper is discharged, the cutter driving mechanism can also be provided in a slimline space, so that a compact, slimline printer can be provided.

In a printer with a main driving mechanism where gears for driving the platen roller are disposed along a first surface that is perpendicular to the shaft of the platen roller, it is preferable for the gears and/or arms included in the cutter driving mechanism to be disposed along a second surface that is perpendicular to the first surface and to include an engaging unit or linking part for linking to one of the gears of the main driving mechanism for obtaining power. By providing the cutter driving mechanism not like the main driving mechanism on the first surface that is perpendicular to the shaft of the platen roller but on a second surface that is the upper or lower surface of the printer and where space is available, the cutter driving mechanism can be disposed without increasing the size of the printer in the width direction. By arranging the gears and/or arms that form the gear train in a space on the upper or lower surface of the printer, the cutter driving mechanism can be provided with very little increase in the size of the printer in the thickness direction. By disposing the movable blade so as to slide along the second surface parallel to the cutter driving mechanism, sufficient space for allowing the movable blade to work can be provided with very little increase in the size of the printer in the thickness direction. Accordingly, it is possible to provide a compact, slimline printer that is equipped with a cutter mechanism.

In these printers, the movable blade slides across and along a flat surface includes a reciprocating cutter that performs linear motion and a scissors-type cutter where the movable blade revolves. A scissors-type cutter has a simple driving mechanism, though it is necessary to provide the pivot for the rotation slightly away from the paper feeding route. A reciprocating cutter has a slightly complicated driving mechanism, though the space required for the movement of the movable blade is the most compact, which makes it easy to produce a printer that is compact overall.

The cutter driving mechanism can be driven by the motor that drives the main driving mechanism for rotating the platen roller. In this case, by driving the platen roller when the motor rotates forwards and the movable blade of the cutter when the motor rotates backwards, the platen roller and the cutter can be separately driven merely by controlling the direction of rotation of the motor that drives the platen roller.

In order to make the platen roller or line thermal head detachable, the movable blade that is attached to the platen roller or line thermal head and the cutter driving mechanism is also detachable, so that it is preferable that the engaging unit of the cutter driving mechanism is detachable from the main driving mechanism. When the movable blade is moved together with the platen roller, it is preferable for one of the gears in the main driving mechanism that drives the platen roller to be able to disengage.

Also, with the printer of the present invention, by providing the cutter driving mechanism with a single revolution mechanism whereby the movable blade is driven so as make one reciprocal movement between a home position that is away from the fixed blade and a cutting position when the movable blade operates in cooperation with the fixed blade to cut the paper, the movable blade makes on return movement where the paper is cut and the movable blade returns to the home position, which simplifies the position control over the movable blade. This prevents problems such as the occurrence of paper jams due to the gap between the movable blade and the fixed blade becoming too small during printing.

Blades where the edges are cut from plates can be used as the movable blade and the fixed blade. A movable blade and a fixed blade with this kind of edge can be easily manufactured by press working, which can lower the cost of the cutter. By using this kind of movable blade and fixed blade and disposing the blade edges of both so as to cross one another in an almost parallel state where the edges are tilted by only a very small clearance angle, a sharp cutting action can be maintained over a long period. In order to achieve a sufficient shearing force at the edge parts where the movable blade and the fixed blade touch one another, a clearance angle needs to be provided, though the cutter will become blunt if precautions are not taken to ensure that there will be no significant change in this angle even if abrasion occurs. For this reason, the fixed blade and the movable blade are arranged so as to engage one another in a parallel state while maintained a very small clearance angle, so that even if abrasion occurs, there is no change in the angle at which the tips of the movable blade and the fixed blade come into contact. The durability of the cutter may also be improved by subjecting the fixed blade and the movable blade to a hardening process, such as by sputtering a super-hard material onto the edges of the movable blade and the fixed blade.

It is also preferable for at least one of the movable blade and the fixed blade to be made of a thin metal plate that is flexible. By making at least one of the movable blade and the fixed blade out of a flexible metal plate, the movable blade and fixed blade can be made with the flexible blade being elastically deformed, so that the edges of the movable blade and the fixed blade can be reliably brought into contact and the paper can be reliably cut. Also, in order for the blade edges of the movable blade and the fixed blade that are elastic or flexible to reliably engage and operate, it is preferable for a guide part for guiding, at a position out of the paper, so that a blade edge of the movable blade engages a blade edge of the fixed blade.

BEST MODE FOR CARRYING OUT THE INVENTION

Figure 1:
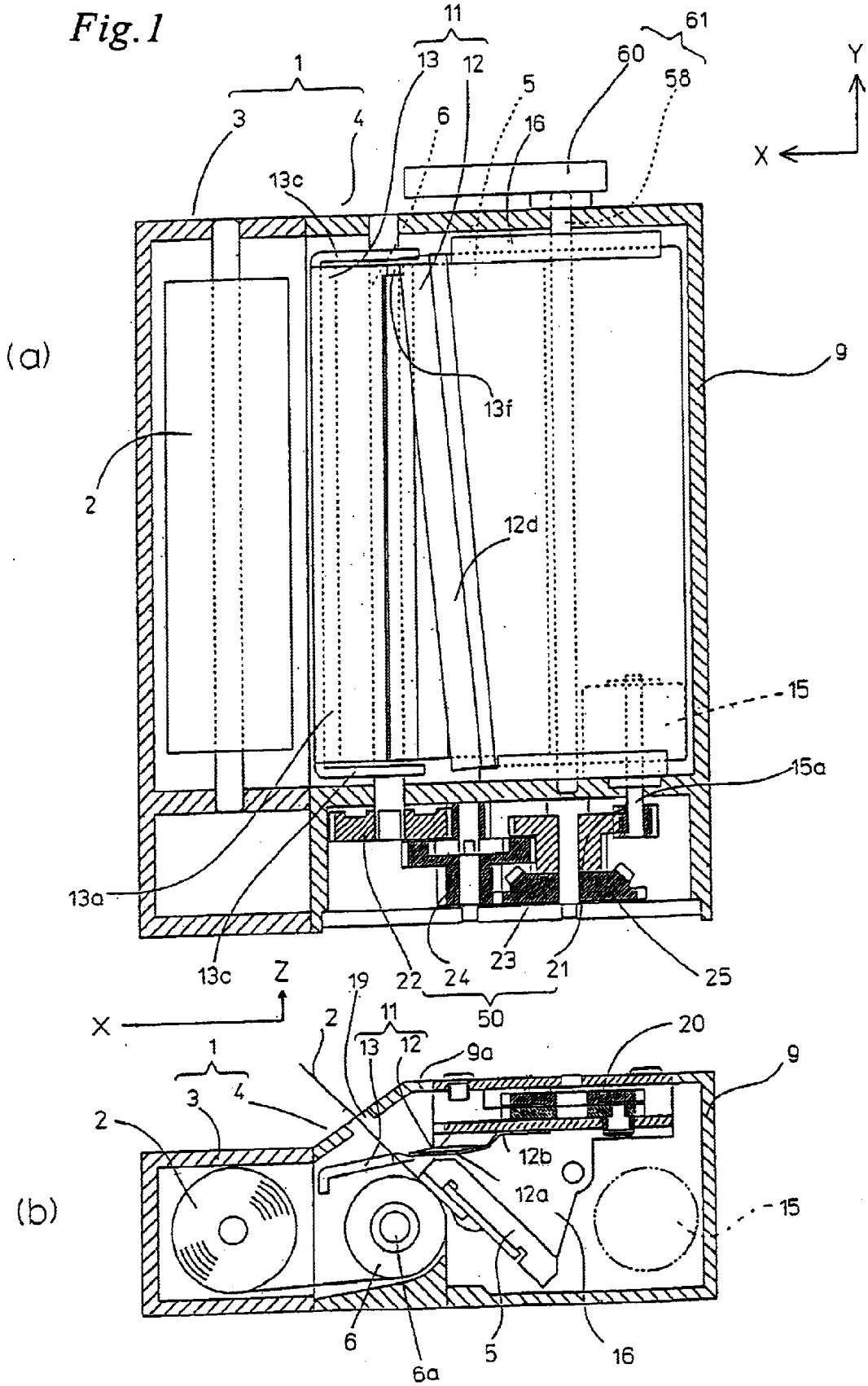
FIG. 1 shows the overall construction of a printer according to the present invention.

The following describes an embodiment of the present invention with reference to the attached drawings. FIGS. 1(*a*) and 1(*b*) show the outline of construction of the printer of the present embodiment partially in cross section. The printer 1 of the present embodiment prints onto the roll paper 2 and is designed so that a cassette 3 that houses the roll paper 2 can be attached to the main printer body 4 that houses the parts that function as the printer. The cassette 3 can be removed from the main printer body 4, so that the cassette 3 and the main printer body 4 can be carried separately.

Via a suitable interface for transmitting and receiving data (not shown in the drawing), such as a USB (Universal Serial Bus) or an infra red interface, the printer 1 of the present embodiment is able to receive print data and control data from a host device such as a mobile computer including a mobile phone, a PDA, and a data processing apparatus including a desktop personal computer.

Figure 2:
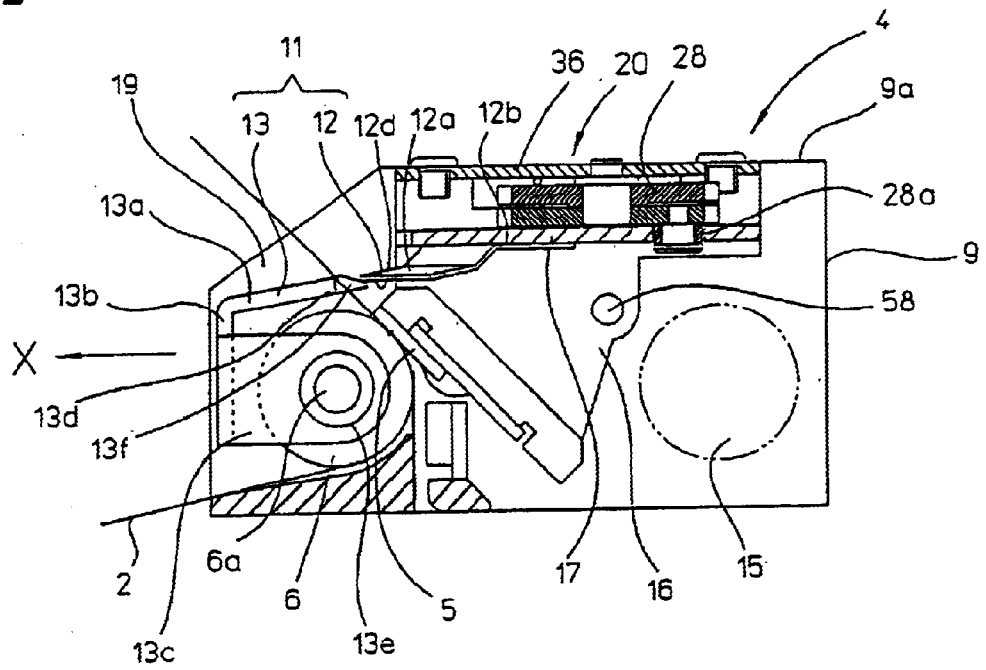
FIG. 2(*a*) is an explanatory drawing showing the movable blade of the cutter in the home position, while FIG. 2(*b*) shows the movable blade in the cutting position.
Figure 2:
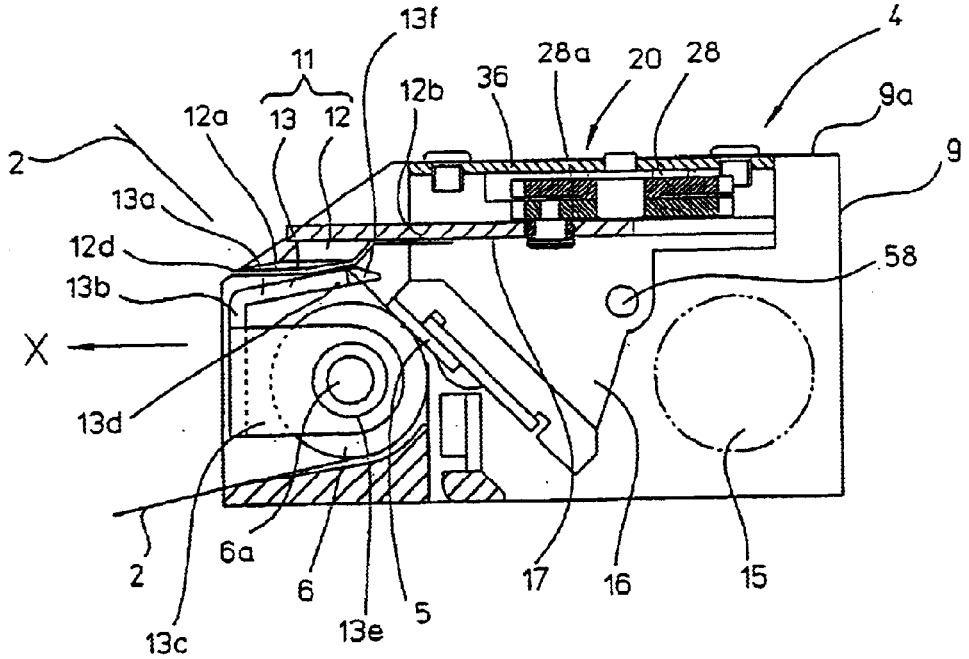

FIG. 1(*b*) shows the outline of construction of the printer 1 in cross section, FIG. 2 shows the construction of the main printer body 4 with partially in cross section. As shown in these drawings, the main printer body 4 includes a line thermal head 5 for printing on the roll paper 2 (continuous paper or paper) that is supplied from the cassette 3, a platen roller 6 for holding the roll paper 2 between the platen roller 6 and the line thermal head 5 and feeding the roll paper 2, a cutter 11 that is equipped with a movable blade 12 and a fixed blade 13 for cutting the roll paper 2, a motor 15 that drives both the platen roller 6 and the movable blade 12 of the cutter 11, and a cutter driving mechanism 20 that receives the power of the motor 15 and drives the movable blade 12. The line thermal head 5 is disposed so as to come into contact with the platen roller 6 from above and at an angle, and is attached via a head supporting plate 16 to the housing 9 or the chassis so as to maintain this position. Accordingly, after the roll paper 2 that is housed in the cassette 3 has been fed by the platen roller 6 and printed upon by the line thermal head 5, the roll paper 2 is discharged from a discharge slot 19 provided on the upper surface 9*a* of the housing 9 of the printer 1 or main printer body 4. Whenever the end part of the printed roll paper 2 that has been discharged reaches a predetermined size, cutting is performed by the cutter 11, so that the discharged roll paper 2 is cut into pieces of a predetermined size such as A7 size (105 mm by 74 mm).

The direction in which the shaft 6*a* of the printer body 4 extends is set as the direction Y and the paper feeding direction that is perpendicular to this direction Y is set as the direction X. The printed roll paper 2 is outputted in a direction Z that extends upward from the X–Y plane. The movable blade 12 of the cutter 11 is attached above the head supporting plate 16 and is capable of linear movement in the direction X. The cutter 11 is a reciprocating cutter in which the movable blade 12 acts in cooperation with the fixed blade 13, which is attached to the shaft 6*a* of the platen roller 6, to cut the roll paper 2. The movable blade 12 is manufactured by cutting a plate into an appropriate form for the movable blade and then appropriately bending the end part 12*a*. The movable blade 12 has an end part 12*a* that extends in the paper feed direction X and a fixed part 12*b* that is attached to a slide plate 17 that works along an upper part of the head supporting plate 16. This fixed part 12*b* is attached via the slide plate 17 or the like to the head supporting plate 16 so that the movable blade 12 moves together with the thermal head 5.

The slide plate 17 can be reciprocally moved in the paper feed direction X by the cutter driving mechanism 20. Together with the slide plate 17, the movable blade 12 performs reciprocal linear motion in the paper feed direction X between the home position H shown in FIG. 2(*a*) where the movable blade 12 is separated or away from the fixed blade 13 and the cutting position C shown in FIG. 2(*b*) where the movable blade 12 acts in cooperation with the fixed blade 13 to cut the roll paper 2, and by moving in this way cuts the roll paper 2.

The fixed blade 13 is also manufactured by cutting a plate and bending it into the form of the fixed blade. The fixed blade 13 has an end part 13*a* that is in the form of a plate that extends in the paper feed direction X and a fixed part 13*b* that is attached to the shaft of the platen roller 6 and supports the end part 13*a*, with the end part 13*a* and the fixed part 13*b* being bent at almost a right angle. Two hooking parts 13*c* that project outwards so as to attach the fixed blade 13 to the shaft 6*a* of the platen roller 6 are provided at the ends of the fixed part 13*b* in the width direction. The fixed blade 13 can be attached to the platen roller 6 by inserting the shaft 6*a* into attachment holes 13*e* formed in these hooking parts 13*c*.

Figure 3:
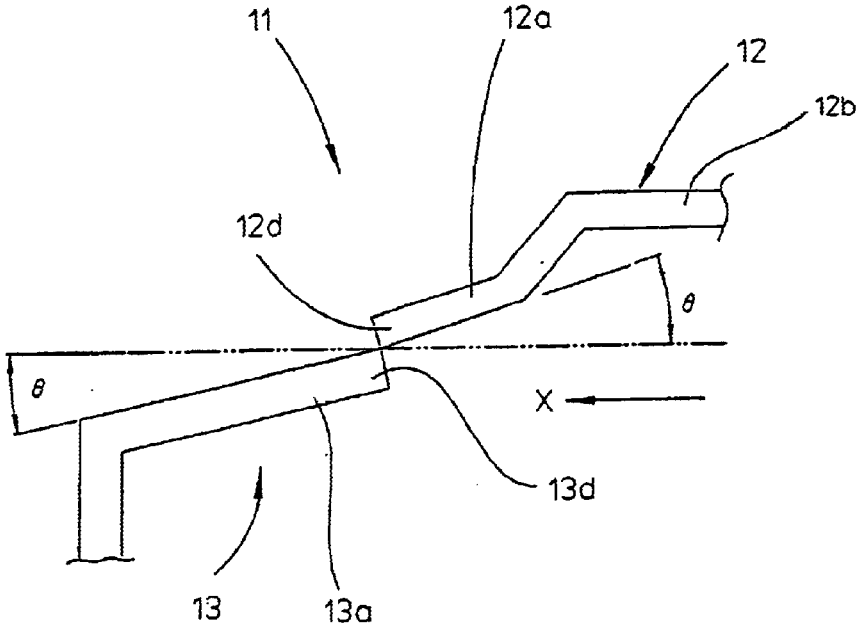
FIG. 3 shows an enlargement of the ends of the movable blade and the fixed blade.

FIG. 3 shows an enlargement of the end part 12*a* of the movable blade 12 and the end part 13*a* of the fixed blade 13. The end part 12*a* of the movable blade 12 is slightly bent with respect to the fixed part 12*b*, and extends so as to be almost parallel with the paper feed direction X, with the end part 12*a* making a very small clearance angle θ of only around a few degrees with respect to the paper feed direction X. The end part 13*a* of the fixed blade 13 is bent at almost a right angle with respect to the fixed part 13*b*, with the end part 13*a* is almost parallel with the paper feed direction X and making a very small clearance angle θ of only around a few degrees with respect to the paper feed direction X. The movable blade 12 and the fixed blade 13 are cut from a plate, and the blade edges of both, which is to say, the blade edge (movable blade edge) 12*d* of the end part 12*a* and the blade edge (fixed blade edge) 13*d* of the end part 13*a* are formed by cutting the plate at a right angle.

When the movable blade 12 with the form described above slides and engages or touches (cooperates with) the fixed blade 13, the blade edges 12*d* and 13*d* engage in a direction that is parallel to the paper feed direction X with the two blade edges being tilted by only the clearance angle θ in opposite directions. Accordingly, only the blade edges 12*d* and 13*d* come into contact. As shown in FIG. 1, the blade edge 12*d* of the movable blade 12 is tilted with respect to the paper feed direction X, so that when the movable blade 12 slides in the paper feed direction X, the blade edge 12*d* of the movable blade 12 touches or engages the blade edge 13*d* of the fixed blade 13 at one point only. Accordingly, the movement of the movable blade 12 results in a shearing force acting progressively across the width on the paper that is present between the blade edge 12*d* and the blade edge 13*d*, thereby cutting the paper.

When the blade edge 12*d* of the movable blade 12 and the blade edge 13*d* of the fixed blade 13, which are tilted by the very small clearance angle θ are combined in this way, there is no significant change in the angles of the blade edges 12*d* and 13*d* even if abrasion occurs at the blade edges, so that a favorable cutting action can be maintained. As a result, even though the cutter can be produced at low cost by pressing out blades from a metal plate, a cutter 11 with superior durability whereby cutting can be performed favorably over a long period can be produced. The durability of the cutter can be further increased by hardening the blade edges 12*d* and 13*d* of the movable blade 12 and the fixed blade 13, such as by sputtering a super-hard material onto the blade edges.

In the cutter 11 of the present embodiment, an end parts 13*f* is formed at the ends of the fixed blade 13 and at a positioned out of the roll paper 2, the end parts 13*f* are tilting extended and ensure that the blade edge 12*d* of the movable blade 12 always slides upon the end parts (guide parts) 13*f*, even when the movable blade 12 is in the home position H. As shown in the enlargement given in FIG. 2(*a*), at the home position H the blade edge 12*d* of the movable blade 12 is positioned slightly below the blade edge 13*d* of the fixed blade 13, with the blade edge 12*d* of the movable blade 12 moving along the guide parts 13*f* and engaging the blade edge 13*d* of the fixed blade 13 at an appropriate position for cutting the paper. In other words, the blade edge 12*d* of the movable blade 12 is guided by the guide parts 13*f* so as to reliably contact the blade edge 13*d* of the fixed blade 13. The movable blade 12 is made from a metal plate with a thickness of around 0.2 mm and is provided with flexibility, and so is capable of elastic deformation with respect to the fixed blade 13 so that two blade edges engage each other. Accordingly, even if abrasion occurs to a certain degree at the blade edges, it is still possible to make the blade edges of the movable blade 12 and the fixed blade 13 reliably contact one another so that the roll paper 2 can be reliably cut over a long period. In this way, a highly reliable and highly durable cutter 11 can be provided at low cost.

In the printer (printer body) 4, the movable blade 12 is disposed on the upper surface 9*a* of the box-like housing 9, which is to say, in a substantially flat state along a flat surface 9*a* on the discharge slot 19 side of the housing 9. The movable blade 12 slides across or along the flat surface 9*a*, which has the largest area in the housing 9, in a flat state. This means that a flat, movable blade 12 is provided on an inside surface of the housing 9, which minimizes the increase in the thickness of the housing 9. The housing 9 is also constructed with a slim space that is sufficient to provide the stroke through which the movable blade 12 works. The gear train (wheel train) of the cutter driving mechanism 20 for moving the movable blade 12 along the upper surface 9*a* of the housing 9 is also disposed across a flat plane. Accordingly, in the printer 4 of the present embodiment, the cutter 11 and the cutter driving mechanism 20 for driving the cutter 11 are formed across surfaces on the inside of the housing 9 and efficiently disposed within a space that is extremely slim.

In the printer 4 of the present embodiment, a gear train 50 (main driving mechanism) that drives the shaft 6*a* of the platen roller 6 is disposed along a side surface (a first surface) of the housing 9 that is perpendicular to the shaft 6*a* of the platen roller 6. The cutter driving mechanism 20, meanwhile, is arranged on the upper surface 9*a* of the housing 9. By not arranging the main driving mechanism 50 and the cutter driving mechanism 20 with the same orientation inside the printer 4, which is to say, on the same side of the printer, but instead arranging the mechanisms in spaces or on surfaces that are perpendicular, the width of the printer 1 is prevented from increasing due to presence the cutter driving mechanism 20. The overall construction of the printer is therefore very compact.

The main driving mechanism 50 and the cutter driving mechanism 20 are linked by bevel gears 25 and 26, so that the cutter driving mechanism 20 can also be driven by the motor 15 that drives the main driving mechanism 50. As a result, only one motor (the motor 15) is needed, making the reduction in the number of parts and a reduction in the space occupied within the printer 1. In this way, a printer equipped with a cutter function can be supplied in a compact form and at low cost.

Figure 4:
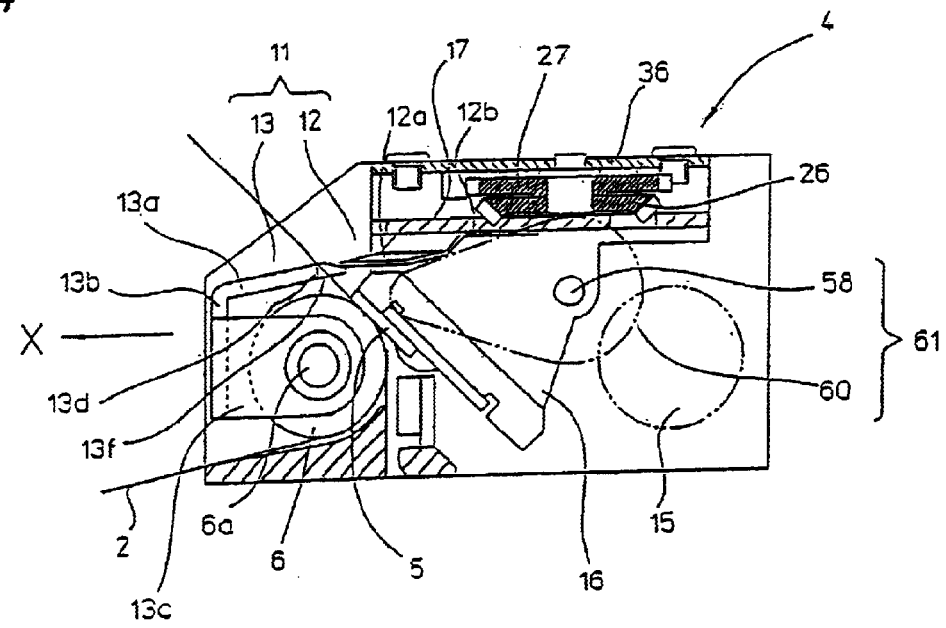
FIG. 4(*a*) shows a state where the line thermal head and the platen roller are in a first position, while FIG. 4(*b*) shows a state where the line thermal head and the platen roller are in a second position.
Figure 4:
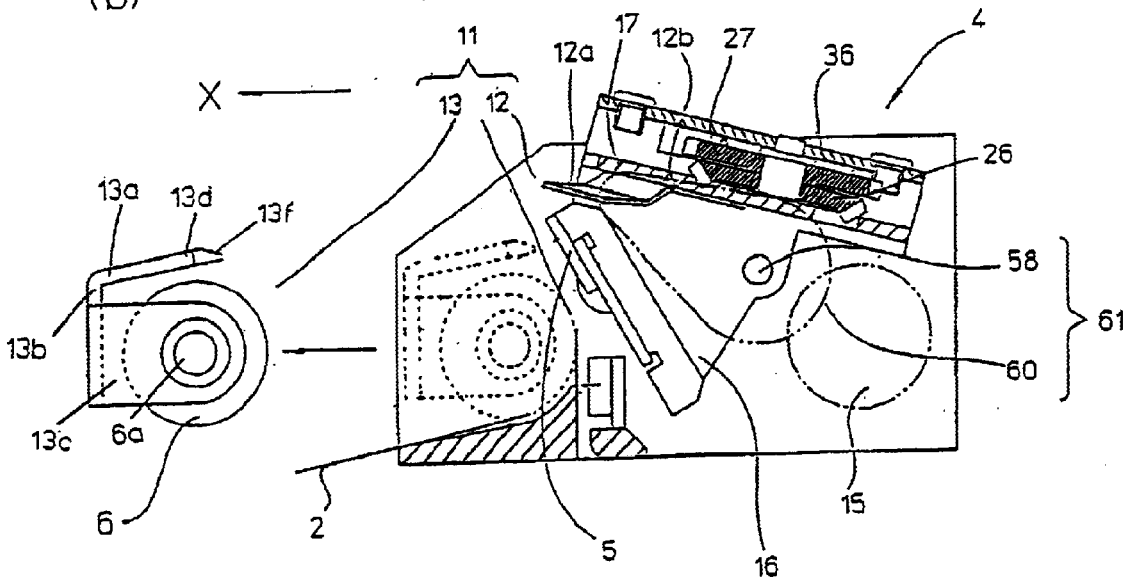

FIG. 4 shows the process when a paper jam has occurred in the printer 1 of the present embodiment. In this printer 1, the head supporting plate 16 is attached to the housing 9 or the chassis by a shaft 58 that extends parallel to the width direction Y of the paper that is perpendicular to the paper feed direction X. When an operation handle 60 that is attached to one end of the shaft 58 is operated, the head supporting plate 16 is rotated by a certain angle, such as around 20°, about the shaft 58. Accordingly, by using a movement mechanism 61 that includes the shaft 58 and the operation handle 60, the user can rotate the head supporting plate 16 and move the line thermal head 5 from the first position P where the line thermal head 5 contacts the platen roller 6 as shown in FIG. 4(*a*) to a second position R where the line thermal head 5 is separated from the platen roller 6 as shown in FIG. 4(*b*). In the second position R, the line thermal head 5 is separated from the platen roller 6 and the roll paper 2 that was held between the two at the first position P is released, so that when a paper jam has occurred, the jammed paper can be removed. Also, at the second position R, the line thermal head 5 is withdrawn upwards, which allows a certain degree of access to the inside of the main printer body 4. This is useful when some paper is left inside the main printer body 4 due to a paper jam or the like, as it makes it easier to remove such paper and so restore the printer 1 to its normal working state.

The movable blade 12 is attached via the slide plate 17 to the head supporting plate 16, so that when the operating handle 60 is operated, the movable blade 12 is rotated together with the line thermal head 5. Accordingly, even when paper has jammed between the movable blade 12 and the fixed blade 13, the paper can be released from the movable blade 12 and the fixed blade 13, meaning that paper jams can be reliably removed by operating the operating handle 60. Since the movable blade 12 and the line thermal head 5 are combined into a single unit, both parts are simultaneously rotated, so that there is no need to remove the line thermal head 5 after first removing the movable blade 12. This makes it extremely easy to withdraw paper jams.

The movable blade 12 is the upper blade with respect to the fixed blade 13, which is positioned above the platen roller 6, and is positioned in the direction in which the line thermal head 5 moves. Accordingly, if a paper jam occurs when the movable blade 12 and fixed blade 13 are in an engaging state or an overlapping state, the user can operate the operating handle 60 to rotate the line thermal head 5 upwards and release the movable blade 12 upwards to release the movable blade 12 from interfering with the fixed blade 13 or the platen roller 6. This makes it possible for paper jams in the printer 1 of the present embodiment to be quickly remedied, even in cases where the movable blade 12 has stopped midway through a cutting operation.

As shown in FIG. 4(*b*), the platen roller 6 is detachable from the main printer body 4. The fixed blade 13 is attached to the platen roller 6, so that when the platen roller 6 is removed, the fixed blade 13 that is combined into a single unit with the platen roller 6 is also removed from the main printer body 4. Accordingly, with the main printer body 4 of the present embodiment, by removing the platen roller 6 from the main printer body 4 instead of moving the line thermal head 5, paper that is held between the platen roller 6 and the line thermal head 5 or between the movable blade 12 and the fixed blade 13 can be released, thereby making it possible to recover paper jams using a simple operation. This main printer body 4 has a construction where the line thermal head 5 can be moved and the platen roller 6 can be removed, so that it is extremely easy to remove paper jams, though so long as one of the line thermal head 5 and the platen roller 6 can be moved, it is possible for the paper jams to be removed.

In this way, in the printer 4 of the present embodiment, the line thermal head 5 and the movable blade 12 are combined into a single movable unit and the platen roller 6 and the fixed blade 13 are combined into another single movable unit. As a result, paper jams can be easily and reliably removed by moving either the line thermal head 5 or the platen roller 6 from a first position P where printing is possible to a second position R where paper jams can be recovered. This makes the printer extremely reliable. No special mechanism or space is required to withdraw the movable blade 12 to a position located away from the path for removing the line thermal head 5, and no special mechanism or space is required to withdraw the fixed blade 13 to a position located away from the path for removing the platen roller 6. As a result, the movable blade 12 and the fixed blade 13 can be arranged into a limited space and with due consideration for maintenance requirements. In this way, a compact, cutter-equipped printer that is suited to being carried and is easy to use can be provided.

A construction for moving the movable blade 12 and fixed blade 13 so as to separate them from the line thermal head 5 and the platen roller 6 is also unnecessary, so that the movable blade 12 can be positioned close to the line thermal head 5 and the fixed blade 13 can be positioned close to the platen roller 6. This makes it possible to locate the position at which the movable blade 12 and the fixed blade 13 engage and cut the roll paper 2 close to the line thermal head 5. The cutter 11 can be arranged into an extremely limited space, and the printed roll paper 2 can be cut near the line thermal head 5. This makes it possible to leave only very little paper as a margin for cutting, and so avoids wasteful use of the roll paper 2. In this way, the present invention provides a printer that can output printed pages that are cut to the size and have a large printable area, making the paper usage efficiency of the printer very high. When the roll paper 2 is cut, the creation of an unnecessary margin can be prevented by rewinding and resetting the paper after cutting by the cutter, though such control is not required in the printer 4 of the present invention. This reduces the time taken by printing operations, and makes a control system and a driving system for performing such a process unnecessary. The present invention also does not suffer from the problem in that when heat sensitive paper is used, rewinding the paper roll results in deterioration of the surface of the paper.

Integrating the movable blade 12 and the line thermal head 5 into a single unit and the fixed blade 13 and the platen roller 6 into another single unit is also advantageous from the viewpoints of design and assembly of the printer 4. Since the movable blade 12 is supported by the head supporting plate 16 of the line thermal head 5, it is not necessary to produce a design or jig for supporting the movable blade 12 from the housing 9 or chassis of the main printer body 4. The same is also true for the fixed blade 13. Accordingly, the cost of the printer can be reduced. It is sufficient for assembling, attaching a component produced in advance by integrating the movable blade 12 and the line thermal head 5 to the housing 9 or chassis of the main printer body 4. The same is also true for the fixed blade 13 and the platen roller 6. This makes it possible to reduce the number of assembly processes, and process for adjusting the alignments of the movable blade 12 and the fixed blade 13 that is usually separated from assembling, can be omitted. Attaching the movable blade 12 to the line thermal head 5 either directly or indirectly via the head supporting plate 16 or the like and attaching the fixed blade 13 to the platen roller 6 either directly or indirectly via a suitable jig or the like not only makes it extremely easy to remove paper jams but as described above is also very advantageous with regard to the design and assembly of the printer, making this an effective technique for providing a compact, cutter-equipped printer at low cost.

Figure 5:
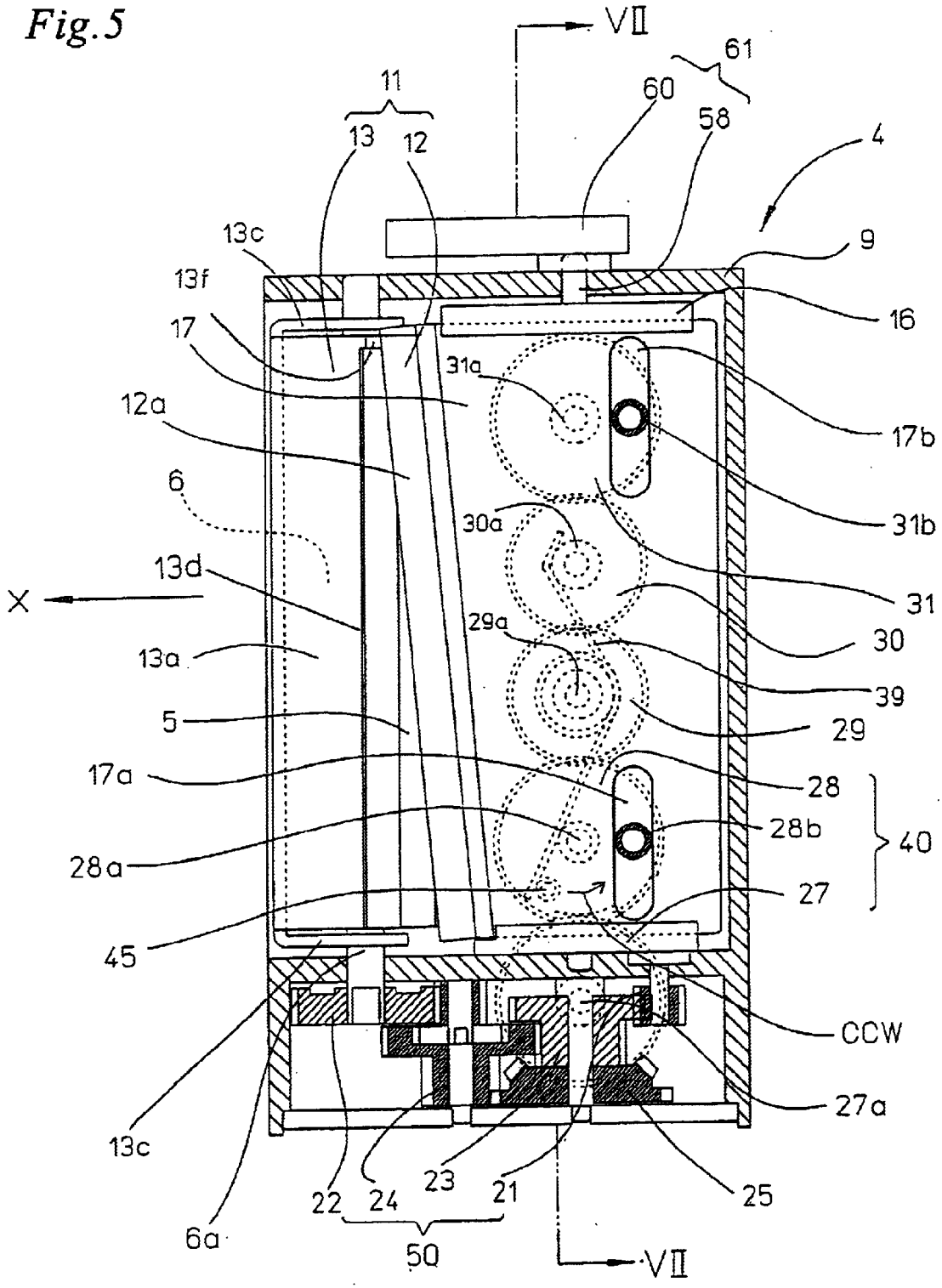
FIG. 5 shows the cutter driving mechanism and the main driving mechanism in the printer shown in FIG. 1 when the movable blade of the cutter is in the home position.
Figure 6:
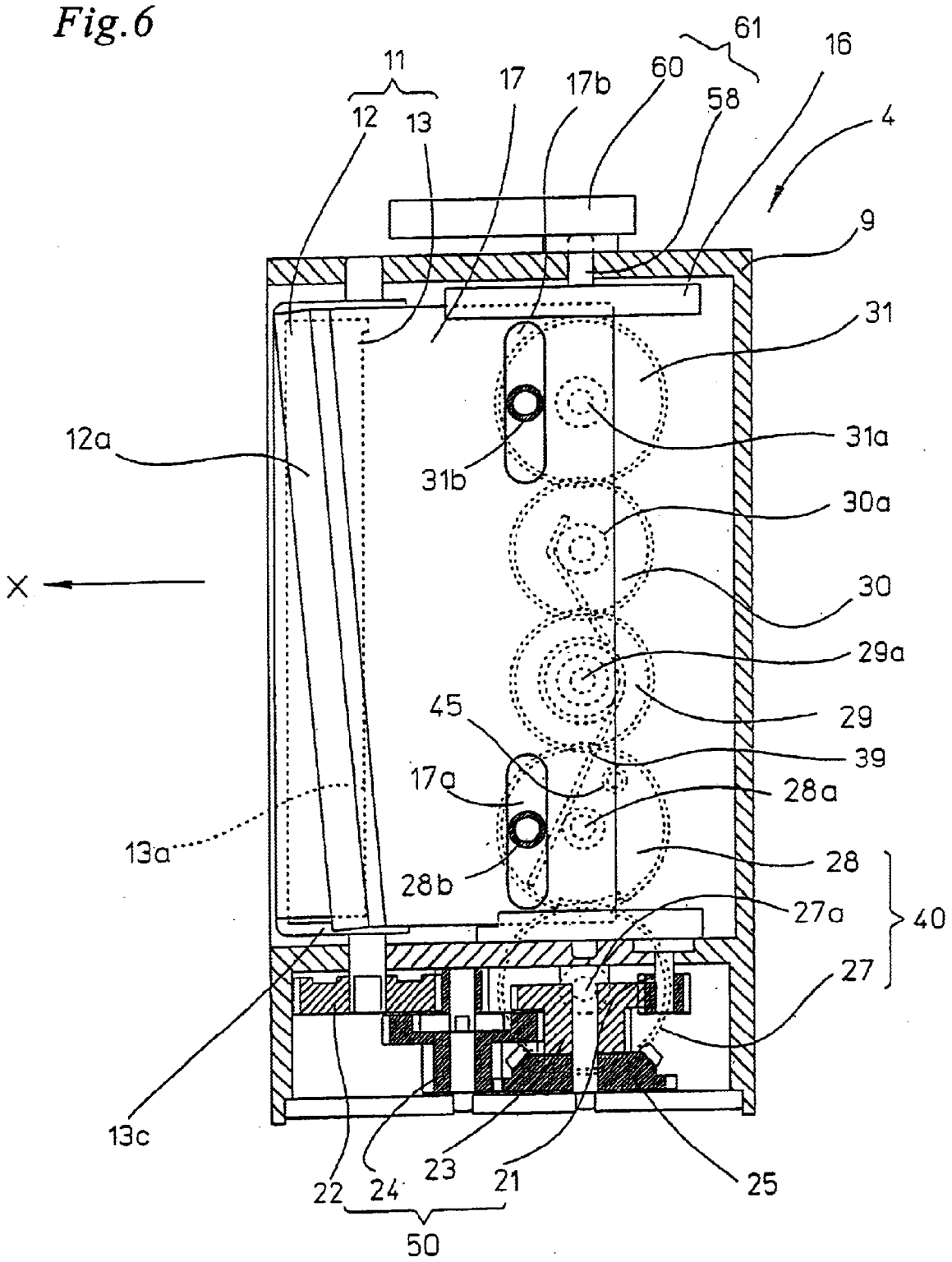
FIG. 6 shows the cutter driving mechanism and the main driving mechanism in the printer shown in FIG. 1 when the movable blade of the cutter is in the cutting position.
Figure 7:
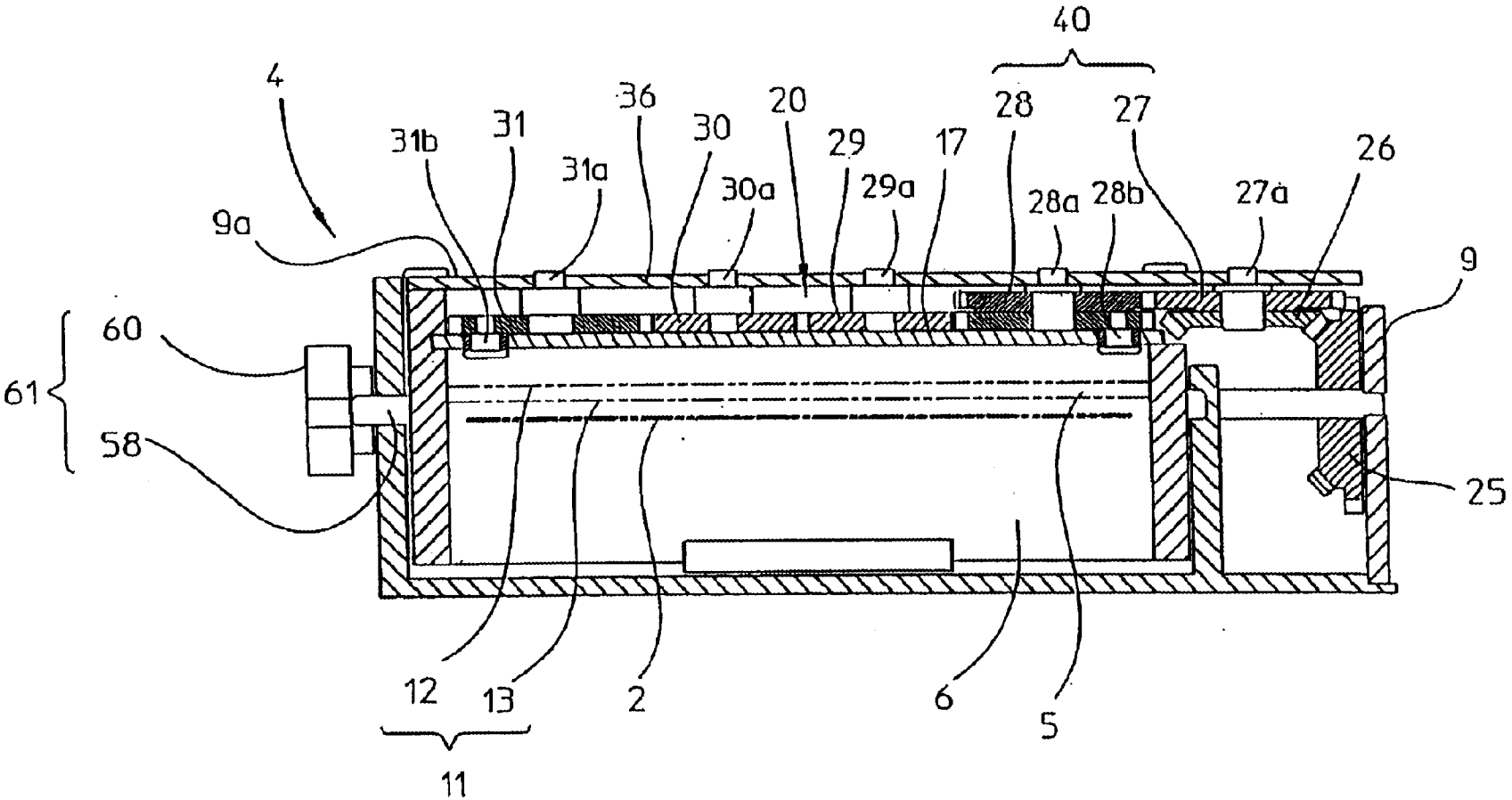
FIG. 7 shows the construction of the cutter driving mechanism of the printer shown in FIG. 1.

FIG. 5 to FIG. 7 show the cutter driving mechanism 20 and the main driving mechanism 50. The cutter driving mechanism 20 drives the movable blade 12 by sliding the slide plate 17 parallel to the upper surface 9*a* of the housing 9 with respect to the head supporting plate 16 in the paper feed direction X, and the main driving mechanism 50 drives the platen roller 6. In the printer 4 of the present embodiment, the cutter 11 and the platen roller 6 are both driven by the motor 15. To do so, the movable blade 12 and the platen roller 6 are separately controlled by switching the rotational direction of the motor 15. The main driving mechanism 50 includes a pinion 21 that is fixed to a shaft 15*a* of the motor 15, a gear 23 that engages the pinion 21, a one-way clutch 24 that engages the gear 23, and a gear 22 that is fixed to the shaft 6*a* of the platen roller 6 and engages the one-way clutch 24. These gears are disposed along a first surface or space that is perpendicular to the shaft 6*a* of the platen roller 6. As a result, the entire main driving mechanism 50 can be compactly enclosed in a space of the housing on the side of the platen roller 6.

Figure 8:
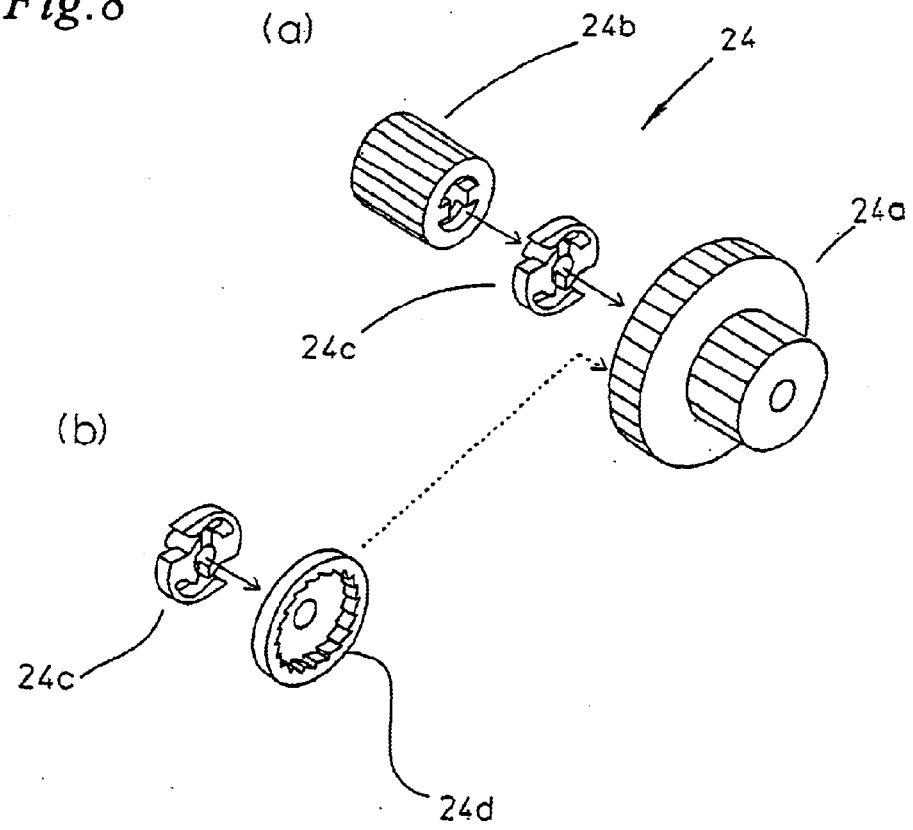
FIG. 8 is an exploded perspective view showing the construction of the one-way clutch used in the main driving mechanism.

FIGS. 8(*a*) and 8(*b*) are perspective views of the construction of the one-way clutch 24 in the present embodiment. The one-way clutch 24 is composed of an external gear 24*a* that is driven by the gear 23, an internal gear clutch 24*d* that is fixed to the inside of the external gear 24*a*, a clutch hook 24*c* that engages the internal gear clutch and transmits power only when the internal gear clutch 24*d* is rotating in one direction, and a driven gear 24*b* that rotates together with the clutch hook 24*c*. Accordingly, when the one-way clutch 24 is rotated by the motor 15 in a clockwise direction when looking from the external gear 24*a* side (the rotational direction of the motor 15 in this case being the "forward direction"), the power of the motor is transmitted to the driven gear 24*b*, the platen roller 6 is driven, and the feeding of paper and printing are performed. On the other hand, when the motor 15 rotates in reverse, the power of the motor is not transmitted to the platen roller 6, so that the paper is not fed and printing is not performed. Instead, when the motor 15 rotates in reverse, the power is transmitted to the cutter driving mechanism 20 and the paper is cut.

Figure 9:
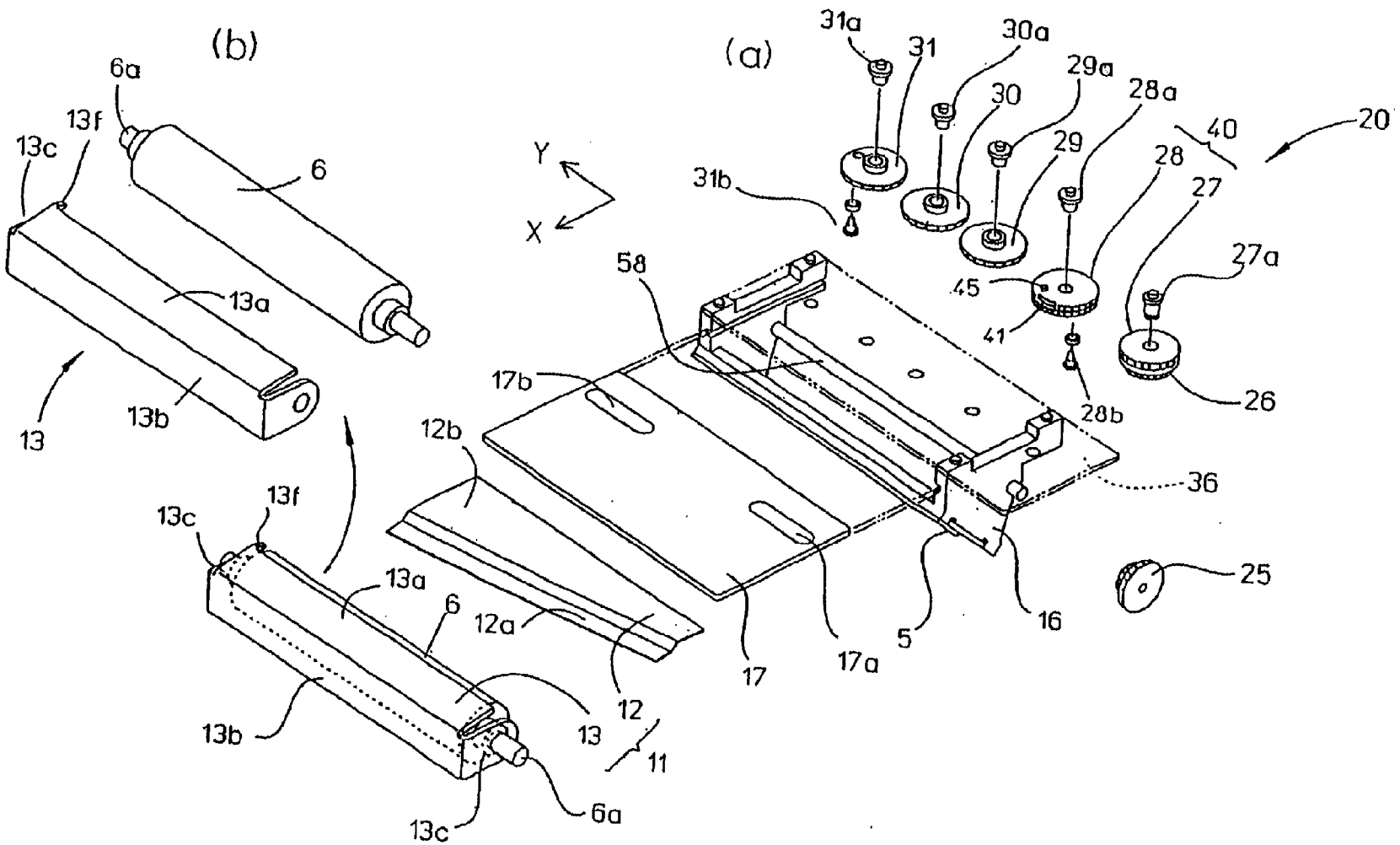
FIG. 9 is a perspective view showing the cutter driving mechanism and the mechanism for attaching the fixed blade to the platen roller.

FIG. 9 is an exploded view of the cutter driving mechanism 20. The cutter driving mechanism 20 is equipped with five gears 27, 28, 29, 30, and 31 that are disposed on an upper plate 36 of the head supporting plate 16, and five gear axles 27*a*, 28*a*, 29*a*, 30*a*, and 31*a* that attach these gears in a freely rotatable manner to the upper plate 36. These gears 27, 28, 29, 30, and 31 are arranged on the same plane along the upper plate 36 that is disposed in parallel with the paper feed direction X.

The cutter driving mechanism 20 is disposed in a plane across or along the upper surface 9*a* of the housing 9, and is arranged in a space or on a surface (the second surface) that is perpendicular to the surface (the first surface) on which the main driving mechanism 50 is arranged. As a result, the provision of the cutter driving mechanism 20 can be prevented from causing an increase in the size of the sides of the printer 1 or causing a large increase in the thickness of the printer 1, so that the cutter driving mechanism 20 and cutter 11 can be collectively arranged in an extremely slim space inside the printer 1 or the housing.

In the printer 1 or main printer body 4 of the present embodiment, the main driving mechanism 50 is arranged on a side surface of the printer 1 or the main printer body 4 so as to be perpendicular to the shaft 6*a* of the platen roller 6 and the shaft 15*a* of the motor 15 that are disposed in parallel. The cutter driving mechanism 20 and the movable blade 12 are arranged on the upper surface of the head supporting plate 16 so as to be parallel with components like the shaft 6*a*, and an approximately rectangular housing 9 is designed so as to cover the cutter driving mechanism 20 and the movable blade 12. The effect of the cutter driving mechanism 20 and the cutter 11 on the thickness of the housing 9 can therefore be minimized, so that a cutter and its driving mechanism can be arranged with very little increase in the thickness of the main printer body 4 or the printer 1 and with sufficient space being provided for the movable blade 12 to work. According to the printer 1 and main printer body 4 of the present embodiment, a cutter 11 can be incorporated in a compact and extremely slimline form so that the thickness of the printer 1 and main printer body 4 are minimized.

The gears of the cutter driving mechanism 20 are arranged perpendicular to the main driving mechanism 50 that drives the platen roller 6, so that the driving force is transmitted by a combination of bevel gears. To do so, a bevel gear 25 is attached to the gear 23 of the main driving mechanism 50 and the gear 27 of the cutter driving mechanism 20 is provided with a bevel gear 26 that engages the bevel gear 25 of the main driving mechanism 50. When the user operates the operating handle 60 and rotates the head supporting plate 16, the bevel gear 26 provided on the cutter driving mechanism 20 side rotates together with the head supporting plate 16 (see FIG. 4(*b*)) and is separated from the bevel gear 25 provided on the main driving mechanism 50 side. Consequently, with the cutter driving mechanism 20 and the main driving mechanism 50 of the present embodiment, the bevel gears 25 and 26 function as engaging unit or linking part that link the main driving mechanism 50 and the cutter driving mechanism 20 and transmit power. When the line thermal head 5 has moved, the engagement of the bevel gears 25 and 26 is released and the cutter driving mechanism 20 is mechanically separated from the main driving mechanism 50. Accordingly, instead of performing rotation and releasing the line thermal head 5 as in the present embodiment, it is also possible to use a disassembly or assembly method where the line thermal head 5 is withdrawn or detached together with the movable blade 12, with the movement of the line thermal head 5 to such a position also falling within the scope of the present invention. On the other hand, with a construction where the line thermal head 5 is released by performing rotation, it is also possible to use a design where the bevel gears 25 and 26 are in an engaged state during the rotation for release.

In the cutter driving mechanism 20 of the present embodiment, the power transmitted via the bevel gear 26 is thereafter transmitted in order by the gears 27, 28, 29, 30, and 31. The wheel train of the cutter driving mechanism 20 is constructed so that the gears 28 and 31 have a gear ratio of 1-to-1 and rotate in synchronization. These gears 28 and 31 are respectively provided with driving pins 28*b* and 31*b* for sliding the slide plate 17 in the paper feed direction X to drive the movable blade 12, with the driving pins 28*b* and 31*b* projecting downwards from the gears 28 and 31 at positions located away from the centers of rotation of these gears. On the other hand, two guide slots 33*a* and 33*b* are formed in the slide plate 17 in the shape of ellipses that extend in a direction perpendicular to the paper feed direction X. The slide plate 17 is assembled so as to be able to move (slide) in the paper feed direction X and so as to press the cutter driving mechanism 20 onto the bottom (the thermal head side) of the upper plate 36 that is fixed to the upper surface of the head supporting plate 16. The driving pins 28*b* and 31*b* are inserted into the guide slots 33*a* and 33*b*. When the gears 27 to 31 rotate, the driving pins 28*b* and 31*b* also rotate, causing the slide plate 17 to slide reciprocally in the paper feed direction X. As a result, the movable blade 12 that is fixed to the slide plate 17 moves between the home position H and the cutting position C.

Figure 10:
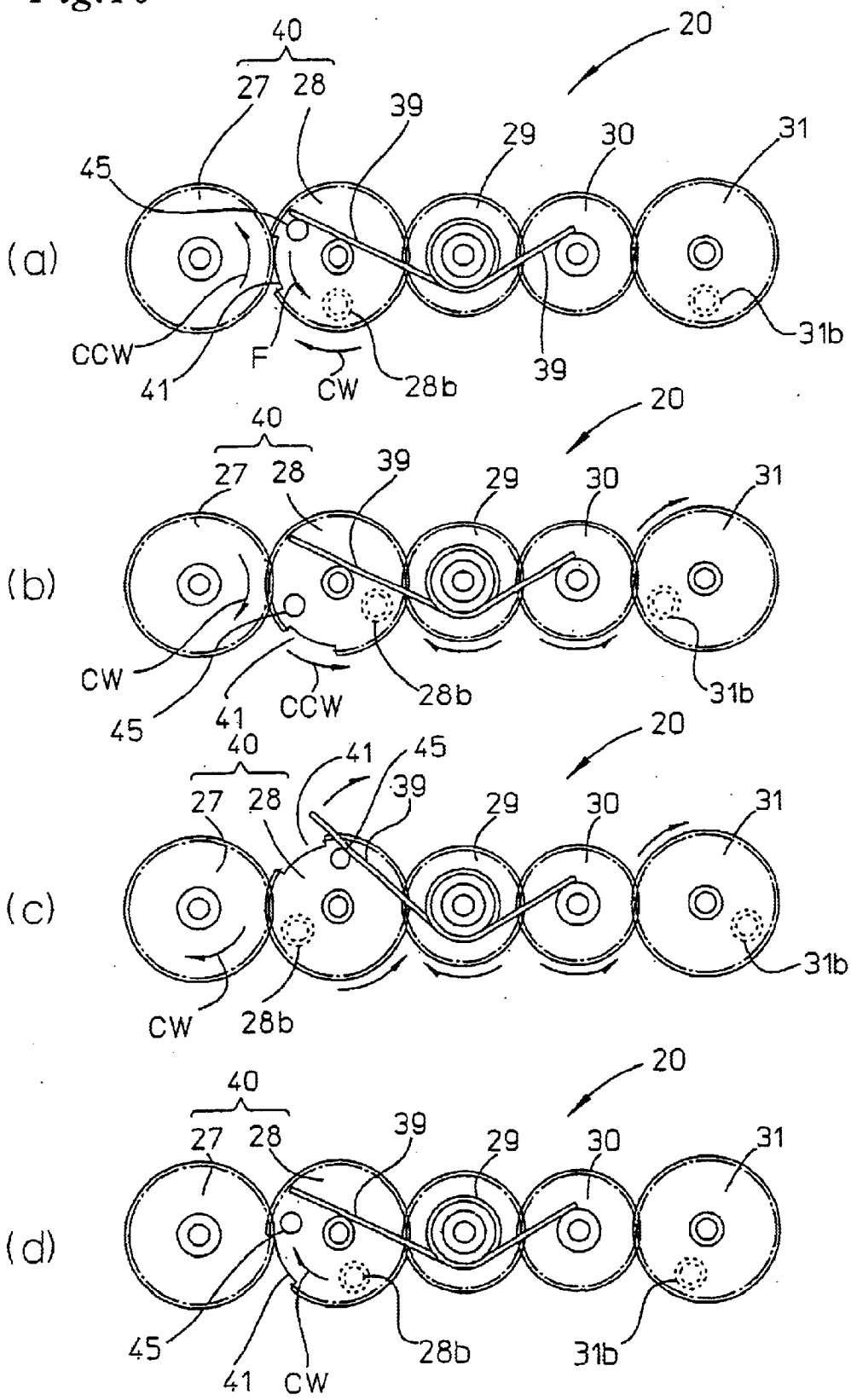
FIG. 10 is used to explain the operation of the cutter driving mechanism.

FIG. 10 shows the operation of the cutter driving mechanism 20 in order. A clutch part 41, where some of the teeth have been removed, is formed in the gear 28 of the cutter driving mechanism 20 of the present embodiment. An engagement pin 45 is also provided on the gear 28 at a position away from the center of rotation and is subject to pressure applied by a plate spring 39 in a predetermined direction, which in the present embodiment is the CCW (counter-clockwise) direction when looking from above the cutter driving mechanism 20. In this way, the gears 28 and 27 form a single revolution clutch 40. When the clutch part 41 is in contact with the gear 27, the force F presses the gear 28 in the CCW direction, so that even if the gear 27 rotates in the CCW direction, the gears do not engage and the power is not transmitted. On the other hand, when is the gear 27 rotates in the CW (clockwise) direction, the gear 27 engages the gear 28 and the power is transmitted. When the gear 27 rotates and causes a single revolution or rotation of the gear 28, the movable blade 12 makes one reciprocal movement between the home position H and the cutting position C. After this, if the gear 27 rotates in the CCW direction, the gear 28 returns to the angle where the clutch part 41 contacts the gear 27 and pressure is applied by the plate spring 39. Accordingly, when the gear 27 rotates in the CCW direction and printing is performed, the angle of the gear 28 is kept constant, so that during printing the movable blade 12 is set at the home position H. In other words, by using the single revolution clutch 40, the home position of the movable blade 12 can be reliably maintained without providing an optical sensor or limit switch. By doing so, a cutter driving mechanism 20 can be provided with high positional accuracy in spite of having a simple construction.

As shown in FIG. 10(*a*), when the motor 15 rotates in the forward direction to drive the platen roller 6, the gear 27 rotates in the CCW direction, though due to the clutch part 41 of the gear 28 and the plate spring 39, power is not transmitted from the gear 27 to the gear 28. The gears 28 and 31, to which the driving pins 28*b* and 31*b* are attached, do not rotate, so that the slide plate 17 does not slide and the movable blade 12 remains stationary at the home position H.

Next, as shown in FIG. 10(*b*), when the motor 15 rotates in reverse, the gear 27 rotates in the CW direction, and the gears 28 and 27 engage due to the spring 39, so that the gear 28 rotates in the CCW direction. Accordingly, power is transmitted to the gears 28, 29, 30 and 31, and the positions of the guide pins 28*b* and 31*b* change in accordance with the rotation of the gears 28 and 31. The slide plate 17 slides in the paper feed direction X so that the movable blade 12 slides from the home position H towards the cutting position C. The paper is then cut by the combination of the movable blade 12 and the fixed blade 13.

Also, as shown in FIG. 10(*c*), when the gear 28 has rotated by almost 360° and the movable blade 12 has returned to close to the home position H, the clutch part 41 of the gear 28 engages the gear 27 once more, returning the cutter driving mechanism 20 to the state shown in FIG. 10(*a*). As shown in FIG. 10(*d*), even when the gear 28 has been rotated by 360° or more by the gear 27, if the motor is then rotated in the forward direction and the gear 27 rotates in the CCW direction, the gear 28 rotates in the CW direction until the angle is reached where the clutch part 41 comes into contact with the gear 27. When the state shown in FIG. 10(*a*) is reached where the clutch part 41 touches the teeth of gear 27, but the teeth of the two gears no longer engage, the gear 28 stops rotating. Accordingly, even if the rotational angle of the gear 27 is not controlled with particularly high precision, there is no possibility of errors in the rotation angle being accumulated and causing a decrease in the accuracy for the home position H of the movable blade 12, which can lead to paper jams due to the movable blade 12 stopping in an insufficiently position.

In the cutter driving mechanism 20 of the present embodiment, the position of the movable blade 12 can be reliably controlled without providing a position sensor or the like for detecting the home position H of the movable blade 12, so that paper cutting operations can be performed by controlling the motor 15 to rotate by a predetermined angle forwards and backwards. The printer does not need to be provided with a dedicated motor for driving the movable blade 12 of the cutter 11, so that a cutter-equipped printer can be made even more compact.

Figure 11:
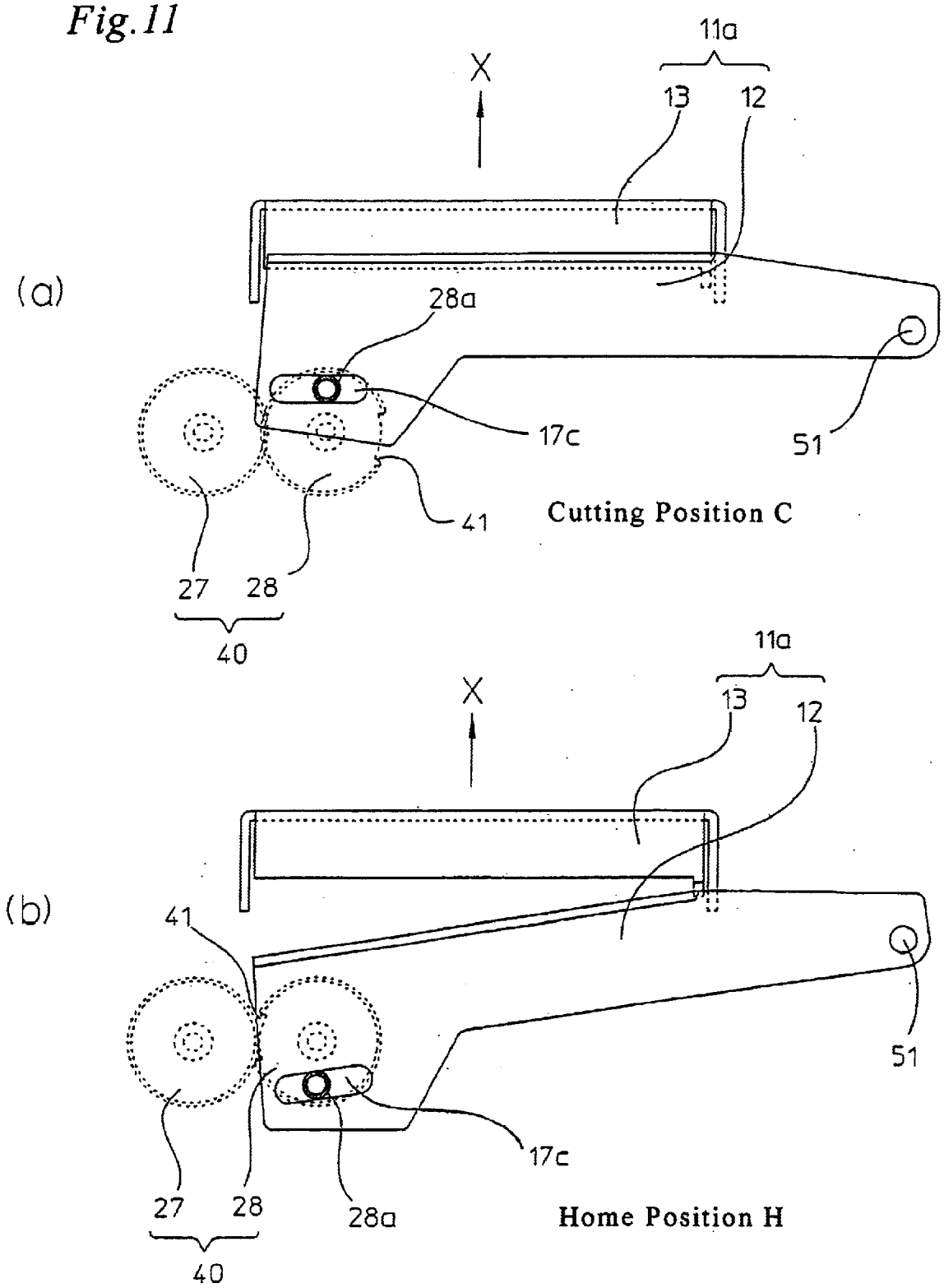
FIG. 11 shows one example of a scissors-type cutter.

It should be noted that while the above explanation describes the case where a cutter 11 that performs reciprocal linear movement in the paper feed direction X is used, it is also possible to use a scissors-type cutter where the movable blade 12 rotates by a certain angle about one end of the movable blade 12 to cut the roll paper 2, as shown in FIGS. 11(*a*) and 11(*b*). The movable blade 12 in a scissors-type cutter 11*a* is supported so as to be free to rotate about one end 51, with an elliptical guide slot 17*c* being formed at the other end of the movable blade 12. Also, in this example too, if a cutter driving mechanism 20 is used where power from the main driving mechanism 50 is transmitted from the gear 27 that is linked to bevel gears as described above, by inserting the driving pin 28*a* of the gear 28 into the guide slot 17*c*, the movable blade 12 can be rotated about the supported end 51, so that in combination with the fixed blade 13, the movable blade 12 can cut the paper. Also, by providing a clutch part 41 on the gear 28 so as to add a single revolution clutch 40 function to the cutter driving mechanism 20, the scissors-type cutter 11*a* can be provided with the same high positional accuracy as in the case described above.

In the scissors-type cutter 11*a*, only one end of the movable blade 12 needs to rotate, so that the construction of the cutter driving mechanism 20 is simplified. On the other hand, at the home position shown in FIG. 11(*b*), the roll paper 2 will come in contact with the scissors-type cutter 11*a* unless sufficient space for the paper width is provided between the movable blade 12 and the fixed blade 13. This means that it is necessary to provide the rotational pivot 51 at a position that is slightly away or out from the paper width, so that the housing or chassis of the printer needs to be wider than the paper width, thereby making it may difficult to produce a compact construction. However, in a printer in which components such as a battery case and/or a control mechanism are arranged in the width direction, the rotational pivot 51 of the movable blade 12 can be provided on top of such components, in which case the scissors-type cutter 11*a* can be provided easily.

On the other hand, in the above printer 1 in which the movable blade 12 slides linearly in the paper feed direction X, it is preferable for the movable blade 12 or the slide plate 17 to be driven at two positions corresponding to both sides in the paper width direction Y so that the movable blade 12 can be slide in parallel. While this tends to make the construction of the cutter driving mechanism 20 complicated, the range of movement of the movable blade 12 is minimized, so that the construction of the printer can be made compact. Also, by arranging the movable blade 12 so that the movable blade 12 slides parallel with the paper feed direction X, it is possible to arrange the movable blade 12 over the line thermal head 5 in a slimline arrangement. It is thought that this construction is suited to the realization of the most compact and slimline printer possible. Also, in the present embodiment, the plurality of gears that function as the cutter driving mechanism 20 for driving the movable blade 12 in a parallel manner are arranged in a straight line and transmit power in the paper width direction, though it is also possible to use an another power transmission mechanism that can be arranged on a plane on the upper surface 9*a* of the housing 9, such as a mechanism where a plurality of arms or levers are linked and/or a combination of gears are used.

Figure 12:
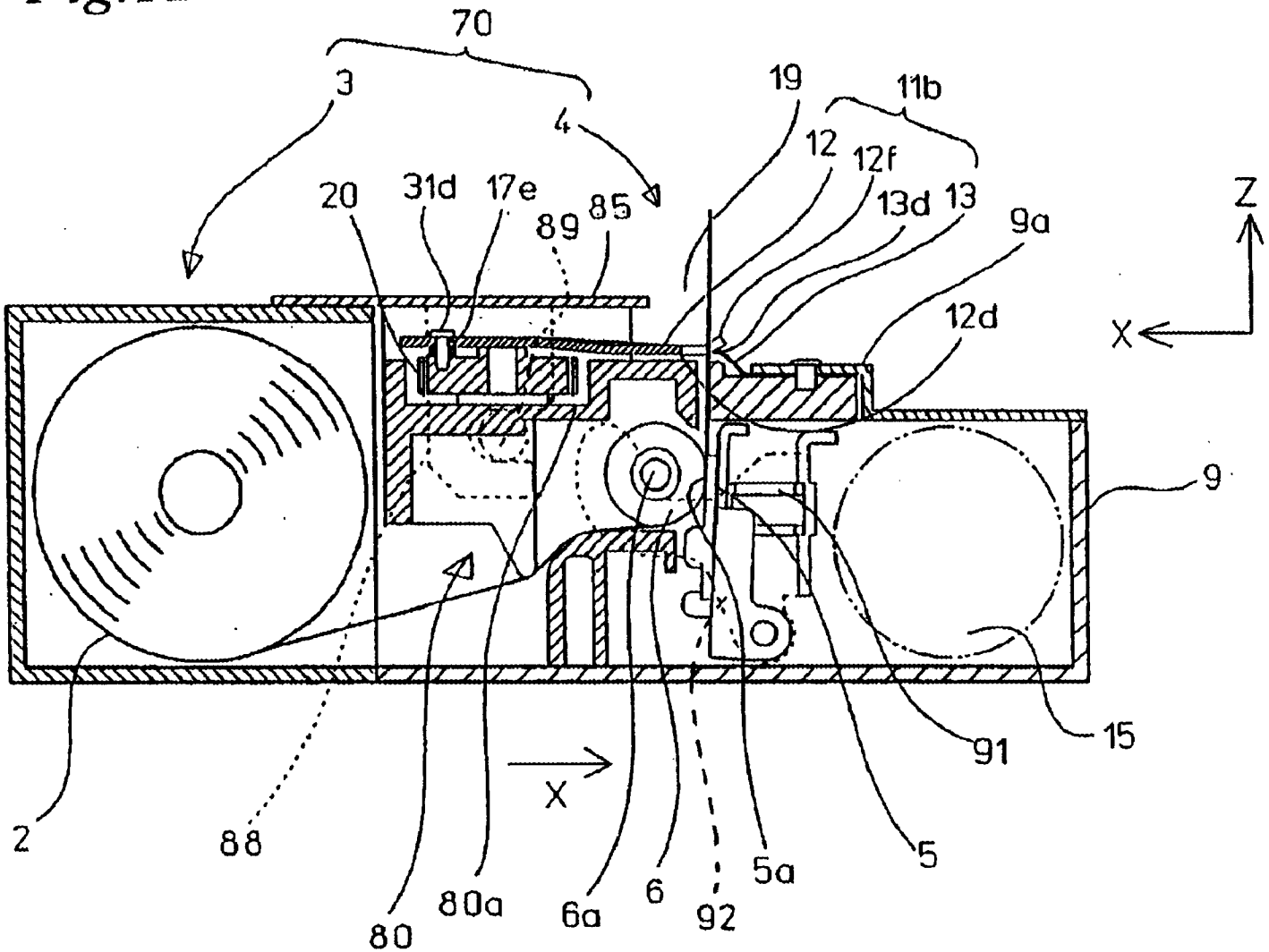
FIG. 12 shows a printer in which a movable blade has been attached to the platen roller.

In the above example, the movable blade 12 is attached to the line thermal head 5 and the fixed blade 13 is attached to the platen roller 6. As in the cutter 11*b* shown in FIG. 12, however, a printer 70 may be produced where the movable blade 12 is attached to the platen roller 6 and the movable blade 12 moves or is released together with the platen roller 6. It should be noted that the parts that are the same as those of the printer 1 have been given the same reference numerals. In the main printer body 4 of the printer 70, the line thermal head 5 is disposed almost vertically along the paper discharge direction Z, with the printing surface 5*a* of the line thermal head 5 being arranged so as to face the side of the cassette 3 that encloses the roll paper 2. The platen roller 6 is disposed on the main printer body 4 side of the printing surface 5*a*, and printing is performed with the roll paper 2 held between the platen roller 6 and the line thermal head 5. The printed roll paper 2 is then discharged almost vertically in the paper discharge direction Z from a discharge slot 19 provided in the upper surface 9*a* of the housing 9.

In the present printer 70, the fixed blade 13 that is disposed above the line thermal head 5 is fixed to the housing 9, with the blade edge 13*a* of the fixed blade 13 extending along the upper surface 9*a* of the housing 9 in the X direction. The movable blade 12 is disposed above the platen roller 6 and slides in a linear manner parallel to the X direction towards the line thermal head 5. This printer 70 also includes a support unit 80 by which the platen roller 6 is supported or on which the platen roller 6 is placed, with the movable blade 12 and the cutter driving mechanism 20 being attached to the upper surface 80*a* of this support unit 80. The movable blade 12 is attached to the platen roller 6 and also the support unit 80. In the same way as in the printer 1, the cutter driving mechanism 20 is arranged across a single plane on the upper surface 80*a* of the support unit 80, so that the cutter driving mechanism 20 can be provided in an extremely slimline thin form. The upper surface 9*a* of the housing 9 also functions as a cover 85 that covers the movable blade 12, with the cover 85 being connected to the support unit 80 via a connecting member 88 that is shaped so as to engage a protrusion 89 provided on the support unit 80. Accordingly, the cover 85 can slide with respect to the support unit 80 in the X direction so that the position of the cover 85 can be finely adjusted.

In addition to the line thermal head 5, the main printer body 4 is equipped with a spring 91 that applies pressure to the platen roller 6 side of the line thermal head 5 and a lever 92 that can insert the shaft 6*a* of the platen roller 6 at a position corresponding to the printing surface 5*a* of the line thermal head 5. When the support unit 80 is attached to the main printer body 4, if the shaft 6*a* of the platen roller 6 is inserted by the lever 92, the line thermal head 5 is pressed by the spring 91 onto the platen roller 6, placing the line thermal head 5 into tight contact with the platen roller 6. The support unit 80 is attached to the main printer body 4 by having the shaft 6*a* of the platen roller 6 held between the lever 92 and the spring 91. Therefore, the shaft 6*a* of the platen roller 6 can be removed upwards away from the lever 92, so that if the support unit 80 is pulled upwards from the main printer body 4, the platen roller 6 can be withdrawn or released from the first position at which printing is possible, allowing the roll paper 2 to be set or paper jams to be removed. Accordingly, in the printer 70 of the present invention, the second position is a position where the platen roller 6 has been removed.

Figure 13:
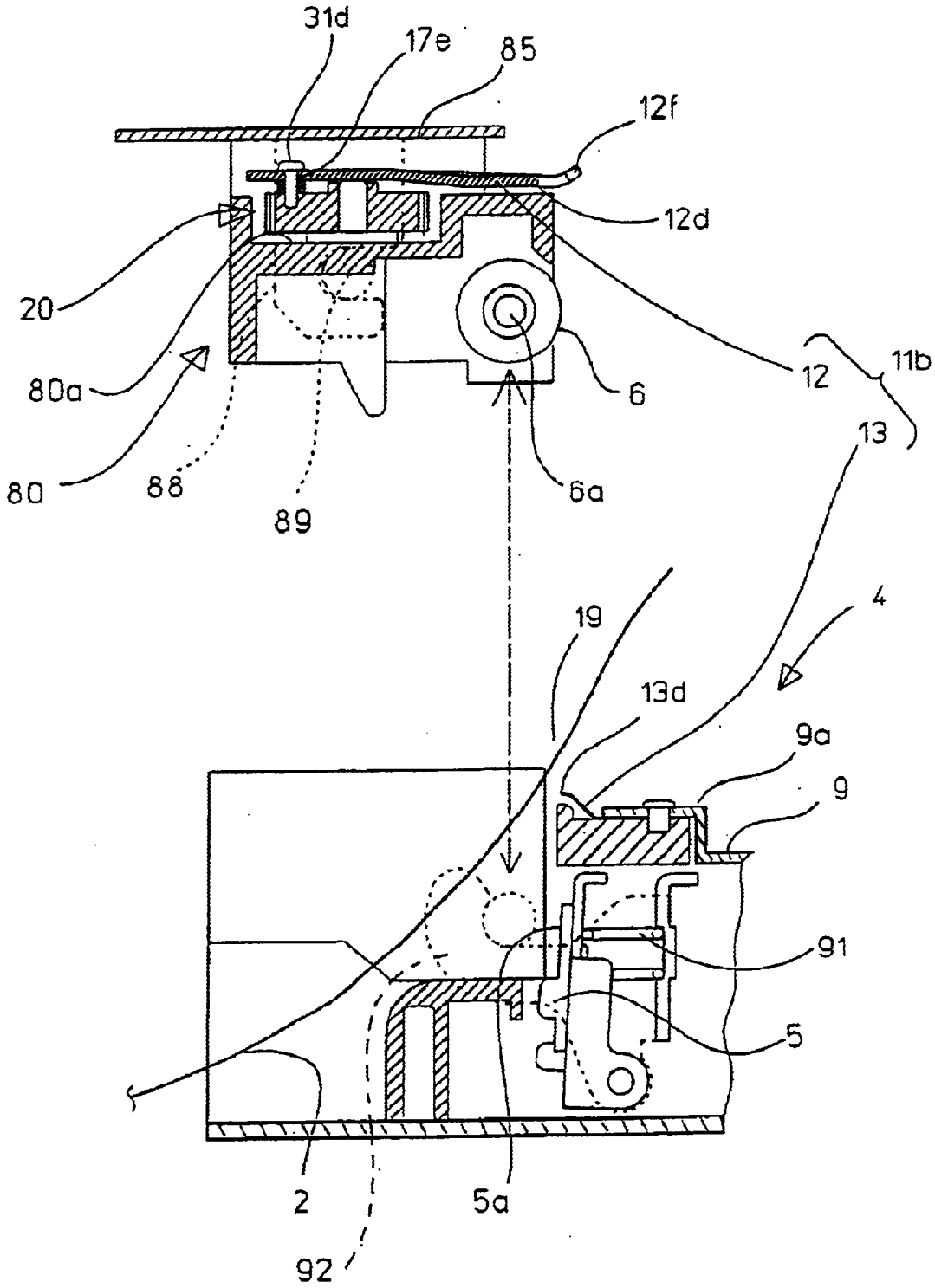
FIG. 13 shows the state of the printer shown in FIG. 12 when the platen roller has been withdrawn from the line thermal head.

FIG. 13 shows the process used when a paper jam has occurred. The support unit 80 is lifted (pulled or slid) up and out of the main printer body 4. By doing so, the platen roller 6 is moved from the first position where the platen roller 6 touches the line thermal head 5 to the second position away from the line thermal head 5, so that the roll paper 2 that was held between the line thermal head 5 and the platen roller 6 is freed. At the same time, the inside of the main printer body 4 becomes wide open, so that the paper feeding path from the cassette 3 to the line thermal head 5 can be easily accessed. When paper is left inside the main printer body 4 due to a paper jam, such paper can be easily removed. To set the roll paper 2, as shown in the drawings the roll paper 2 is simply placed so as to span the path from the cassette 3 to the discharge slot 19 and then the support unit 80 is set back in the printer 70 so that the roll paper 2 is held between the line thermal head 5 and the platen roller 6. The cutter 11*b* is then run once to complete the setting of the roll paper 2.

In this printer 70 also, the platen roller 6 and the movable blade 12 can be moved or released as a single unit or assembly, so that the movable blade 12 does not obstruct for removing the platen roller 6 as in the example given above. The movable blade 12 is positioned above the fixed blade 13, which is to say, in the direction in which the support unit 80 is released, so that a cover is not provided over the fixed blade 13. Even if a paper jam occurs when the movable blade 12 has run so as to engage the fixed blade 13, the support unit 80 and movable blade 12 can be withdrawn by merely lifting up the support unit 80, so that the engagement of the movable blade 12 and the fixed blade 13 can be released. This means that the printer 70 is easy-to-use and highly reliable, and, like the printer described above, provides a compact cutter-equipped printer that is suited to carrying.

It should be noted that while the printer 70 is constructed so that the support unit 80 can be lifted up and completely removed from the housing 9 or main printer body 4, it is sufficient for the printer 70 to be constructed so that the support unit 80 can be slid far enough to separate the platen roller 6 from the line thermal head 5, or so that rotation can be performed as with the printer 1 described above. However, in view of the setting of the roll paper 2, even in the case where the platen roller 6 is separated from the line thermal head 5 by sliding or rotation, it is preferable for the platen roller 6 to be completely removed as shown in FIG. 13. A construction where only the support unit 80 is removed by sliding or rotation may be used, or the support unit 80 may be integrated with the cover of the cassette 3 for setting the roll paper 2. When this type of construction is used, when the cover is opened to set the roll paper 2, the support unit 80 is removed upwards together with the cover, so that paper jams can be removed or solved and the roll paper 2 can be set easily.

When making it possible for the support unit 80 to be lifted out of the top like in the printer 70, it is preferable for the printing surface 5*a* of the line thermal head 5 to be arranged in a Z direction in an upright, almost vertical state. The components in the printer 70 are laid out so that the printed roll paper 2 is discharged in the Z direction while the movable blade 12 slides in the X direction that is almost perpendicular to the Z direction, making it easy to shear the roll paper 2.

Figure 14:
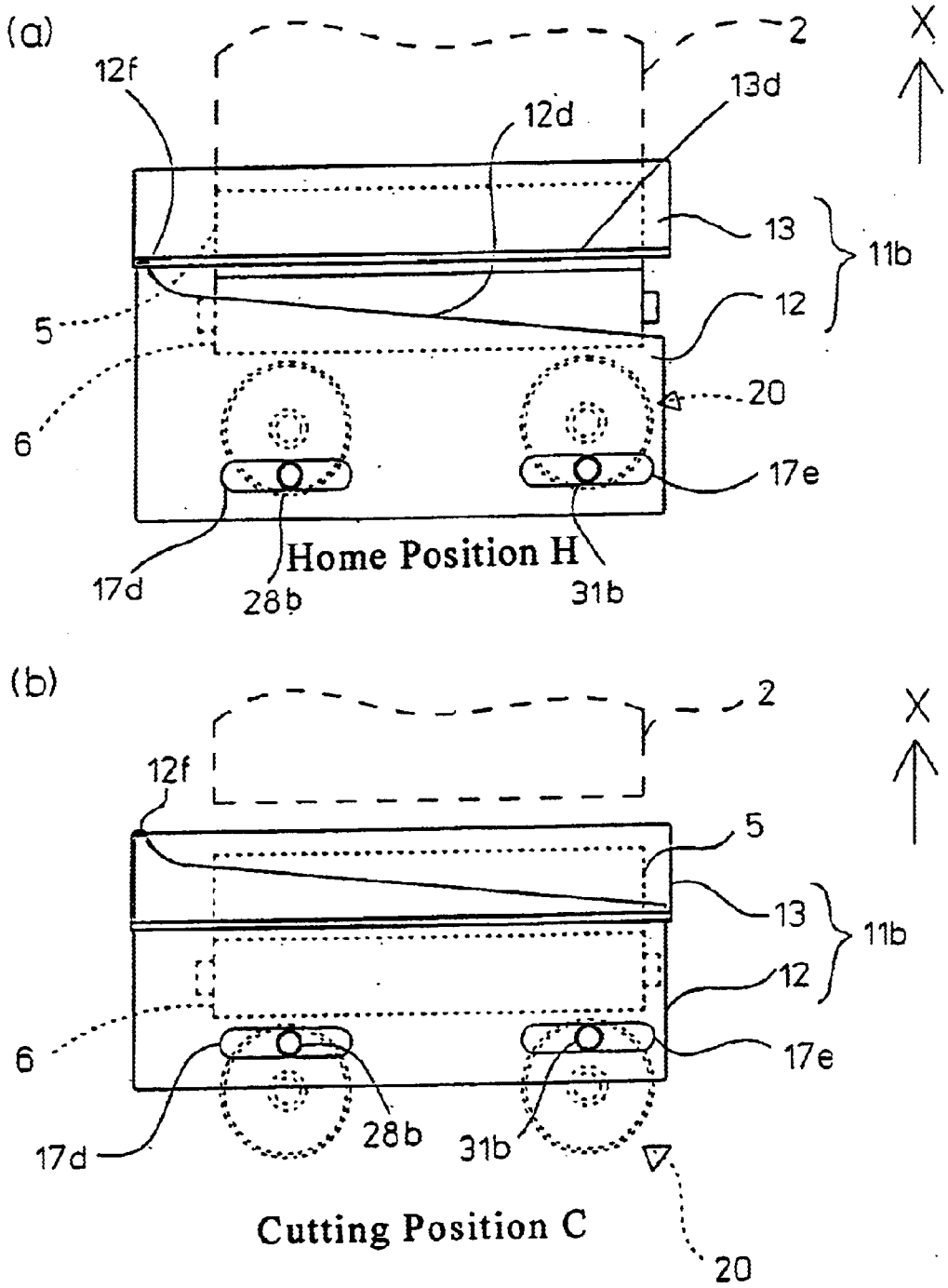
FIG. 14 shows the printer shown in FIG. 12 with the cutter having been removed, with FIG. 14(*a*) showing the home position and FIG. 14(*b*) showing the cutting position.
Figure 15:
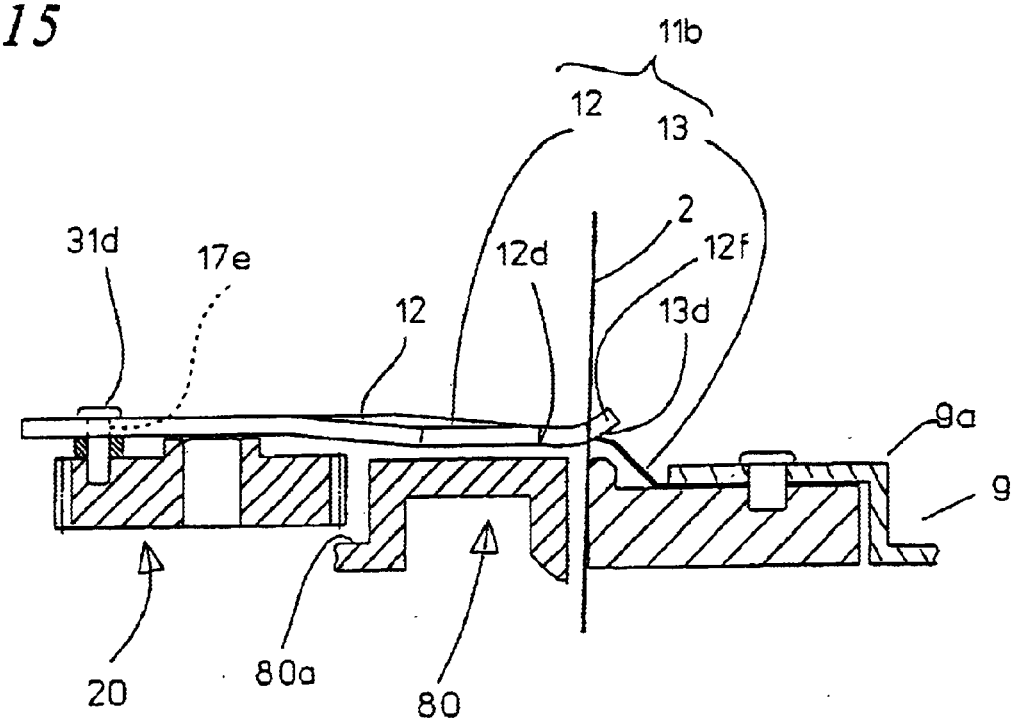
FIG. 15 shows the cutter of the printer shown in FIG. 12, with FIG. 15(*a*) showing a state where the movable blade is in the home position and FIG. 15(*b*) showing a state where the movable blade is in the cutting position.
Figure 15:
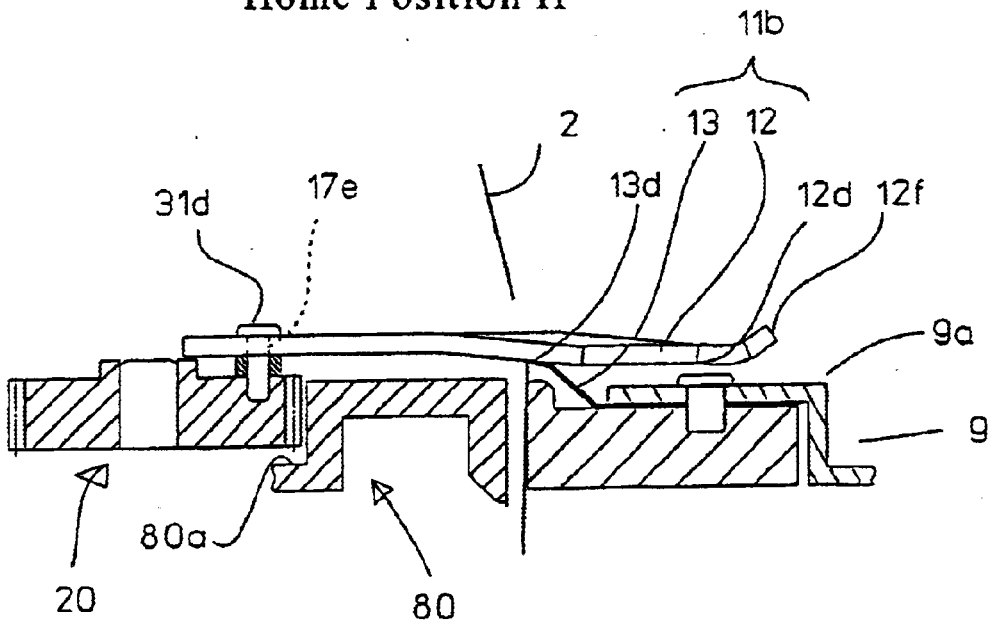

FIGS. 14 and 15 show the cutter 11*b*. Like the cutter 11 that was explained with reference to FIG. 1, the cutter 11*b* in the present example is a reciprocating cutter, with the two elliptical guide slots 17*d* and 17*e* being formed in the movable blade 12 of the cutter 11*b* and the cutter 11*b* being driven by the cutter driving mechanism 20 that was described with reference to FIGS. 9 and 10. The motor 15 has the movable blade 12 of the cutter 11*b* perform linear reciprocal movement between the home position H shown in FIG. 14(*a*) and FIG. 15(*a*) and the cutting position C shown in FIG. 14(*b*) and FIG. 15(*b*) so as to cut the roll paper 2.

In the present example, as shown in FIG. 13, the cutter driving mechanism 20 is disposed between the movable blade 12 and the upper surface 80*a* of the support unit 80, so that the weight of the cutter driving mechanism 20 can be easily supported by the support unit 80. In the printer 1 described earlier, the movable blade 12 is designed so as to move or be released together with the line thermal head 5, with it being possible to disengage the bevel gear 26 that is the linking part. In the present example, however, the movable blade 12 is removed together with the platen roller 6, so it is preferable for the gear 22 of the main driving mechanism 50 that is attached to the shaft 6*a* of the platen roller 6 to be removed together with the support unit 80, and for one of the gears of the main driving mechanism 50, a favorable example being the gear 22, to be disengaged.

In the cutter 11*b* of the present example, the fixed blade 13 is constructed so as to be slim and flexible. As shown in FIGS. 15(*a*) and 15(*b*), when the movable blade 12 slides from the home position H to the cutting position C, the movable blade 12 and the fixed blade 13 elastically deform and the blade edge 12*d* of the movable blade 12 and the blade edge 13*d* of the fixed blade 13 come into contact, so that the roll paper 2 can be reliably cut. Also, the movable blade 12 and the fixed blade 13 are flexible, so that gaps between the blade edges will not appear even if abrasion occurs. This makes the durability and reliability of the cutter even higher.

A front tip 12*f* of the part of movable blade 12 that is positioned out of the paper range is formed as a guide part that is slightly tilted upwards and so functions in the same way as the guide part 13*f* in the cutter 11 described above. This means that at the home position H, the blade edge 12*d* of the movable blade 12 is set so as to be slightly below the blade edge 13*d* of the fixed blade 13, but at the cutting position C, the movable blade 12 becomes the upper blade due to the guide part 12*f*. The movable blade 12 and the fixed blade 13 are set in this way in the initial state of the cutter, and even if the blade edges wear away due to abrasion, the generation of a gap between the blades can be prevented.

In the above description, the single revolution clutch 40 is used to ensure that the home position is accurate, though it is possible to drive the movable blade 12 using a combination of a one-way clutch and a sensor that detects the home position of the movable blade 12. A one-way clutch is also used to distribute power to the platen roller 6 and the cutter driving mechanism 20 according to the rotational direction of the motor, though a different construction, such as a planet gear, may be used. However, since more gears are required with a different construction like a planet gear than with a one-way clutch, using a one-way clutch is most preferable in view of the compactness of the device.

The cutter driving mechanism 20 is not limited to the mechanisms that have been described, so that the number or combination of gears may be changed. It is also possible to use a construction where power is transmitted using an arm or arms in place of gears.

The above embodiment describes a printer where a cassette 3 that encloses the roll paper 2 can be separated from the main printer body 4, though the present invention may also be used in a printer where the cassette 3 is integrated with the main printer body 4 and the roll paper 2 is enclosed within the main printer body 4. The printer 1 of the above embodiment does not require any consumables, making it a compact thermal printer that does not require any space for consumables, and can be provided with a cutter mechanism without significantly affecting the dimensions of the printer. As a result, it is possible to realize a compact printer that can be easily carried and includes a paper storage space which uses roll paper 2 as the printing paper. The printer is designed so that the movable blade 12 or the fixed blade 13 can be moved or removed so that paper jams, such as jams between the blades and the line thermal head 5, can be removed. Therefore, while the incorporation of a cutter mechanism makes the printer more complicated, the printer is still compact and easy to maintain. In this way, it is possible to produce an easy-to-use printer that can print easily and reliably when operated anywhere, at any time, and by anyone.

Industrial Applicability

As described above, the present invention is a compact printer that can print on roll paper, is equipped with a cutter, and has a simple construction. This printer is suited to use as a compact, handy-type printer that can be easily carried with a mobile terminal, such as a mobile telephone, and is easy to use anywhere. The present invention can also be used with all devices that print using roll paper, such as desktop-type roll paper printers, fax machines, and compact photocopiers that use roll paper, with such devices being included in the scope of the expression "printer" given in the following patent claims.

What is claimed is:

1. A printer comprising:

a line thermal head;

a platen roller for holding a paper between the platen roller and the line thermal head and feeding the paper;

a cutter, including a movable blade and a fixed blade, for cutting printed paper; and a cutter driving mechanism for driving the movable blade, wherein at least one of the line thermal head and the platen roller is movable from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller, and further comprising one of a housing and a chassis, a side of which where printer paper is discharged being a substantially flat surface, wherein the movable blade is disposed so as to work alone the flat surface.

2. A printer according to claim 1, wherein when the line thermal head and the platen roller are in the first position, the movable blade is disposed in a direction of the second position with respect to the fixed blade and the movable blade moves together with the one of the line thermal head and the platen roller.

3. A printer according to claim 1, wherein the movable blade is attached to the line thermal head and the fixed blade is attached to the platen roller.

4. A printer according to claim 3, further comprising a mechanism for moving the platen roller to the second position, wherein the fixed blade is attached to a shaft of the platen roller.

5. A printer according to claim 3, wherein the movable blade is attached so as to move along a support plate attached to a line thermal head.

6. A printer according to claim 1, wherein gears and/or arms included in the cutter driving mechanism are disposed along the flat surface where printer paper is able to discharge.

7. A printer according to claim 1, wherein the movable blade slides linearly.

8. A printer comprising:

a line thermal head;

a platen roller for holding a paper between the platen roller and the line thermal head and feeding the paper;

a cutter, including a movable blade and a fixed blade, for cutting printed paper; and a cutter driving mechanism for driving the movable blade, wherein the platen roller is movable from a first position for printing to second position for removing a paper jam, and the movable blade is directly or indirectly attached to the platen roller so that when the platen roller moves from the first position to the second position, the movable blade moves together with the platen roller.

9. A printer comprising:

a line thermal head;

a platen roller for holding a paper between the platen roller and the line thermal head and feeding the paper;

a cutter, including a movable blade and a fixed blade, for cutting printed paper; and a cutter driving mechanism for driving the movable blade, wherein at least one of the line thermal head and the platen roller is movable from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller, and further comprising a main driving mechanism including gears for driving the platen roller disposed along a first surface that is perpendicular to a shaft of the plate roller, wherein gears and/or arms included in the cutter driving mechanism are disposed along a second surface that is perpendicular to the first surface, and the cutter driving mechanism includes an engaging unit for linking to one of the gears of the main driving mechanism and receiving power.

10. A printer according to claim 9, wherein the movable blade is arranged so as to work along the second surface.

11. A printer according to claim 9, wherein the engaging unit is detachable from the main driving mechanism.

12. A printer according to claim 9, wherein the movable blade moves together with the platen roller and one of the gears of the main driving mechanism is disengaged.

13. A printer according to claim 9, further comprising a motor for driving the main driving mechanism, wherein the platen roller is driven when the motor rotates forwards and the movable blade of the cutter is driven when the motor rotates backwards.

14. A printer comprising:

a line thermal head;

a platen roller for holding a paper between the platen roller and the line thermal head and feeding the paper;

a cutter, including a movable blade and a fixed blade, for cutting printed paper; and a cutter driving mechanism for driving the movable blade, wherein at least one of the line thermal head and the platen roller is movable from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller, and wherein the cutter driving mechanism includes a single revolution mechanism that drives the movable blade so as to perform one reciprocal movement between a home position that is away from the fixed blade and a cutting position where the movable blade cuts the paper in cooperation with the fixed blade.

15. A printer comprising:

a line thermal head;

a platen roller for holding a paper between the platen roller and the line thermal head and feeding the paper;

a cutter, including a movable blade, and a fixed blade for cutting printed paper; and a cutter driving mechanism for driving the movable blade, wherein at least one of the line thermal head and the platen roller is movable from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller, and wherein the movable blade rotates.

16. A printer comprising:

a line thermal head;

a platen roller for holding a paper between the platen roller and the line thermal head and feeding the paper;

a cutter, including a movable blade and a fixed blade, for cutting printed paper; and a cutter driving mechanism for driving the movable blade, wherein at least one of the line thermal head and the platen roller is movable from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller, and wherein front edges of the movable blade and the fixed blade are in the form of cut plates and cross each other with the movable blade and the fixed blade in an almost parallel state where the movable blade and the fixed blade are tilted by a very small clearance angle.

17. A printer comprising:

a line thermal head;

a platen roller for holding a paper between the platen roller and the line thermal head and feeding the paper;

a cutter, including a movable blade and a fixed blade, for cutting printed paper; and a cutter driving mechanism for driving the movable blade, wherein at least one of the line thermal head and the platen roller is movable from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller, and wherein at least one of the movable blade and the fixed blade is a thin metal plate which is flexible.

18. A printer comprising:

a line thermal head;

a platen roller for holding a paper between the platen roller and the line thermal head and feeding the paper;

a cutter, including a movable blade and a fixed blade, for cutting printed paper; and a cutter driving mechanism for driving the movable blade, wherein at least one of the line thermal head and the platen roller is movable from a first position for printing to a second position for removing a paper jam, and one of the movable blade and the fixed blade is directly or indirectly attached to one of the line thermal head and the platen roller so that when the one of the line thermal head and the platen roller moves from the first position to the second position, one of the movable blade and the fixed blade also moves together with the one of the line thermal head and the platen roller, and wherein at least one of the movable blade and the fixed blade includes guide part for guiding, at a position out of the paper, so that a blade edge of the movable blade engages a blade edge of the fixed blade.

* * * * *